US009190770B2

(12) United States Patent
Shindo et al.

(10) Patent No.: US 9,190,770 B2
(45) **Date of Patent: *Nov. 17, 2015**

(54) CONNECTOR

(71) Applicant: J.S.T. MFG. CO., LTD., Osaka-shi (JP)

(72) Inventors: Satoru Shindo, Miyoshi (JP); Shinji Tasaka, Miyoshi (JP); Takamasa Yagi, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/249,577

(22) Filed: Apr. 10, 2014

(65) Prior Publication Data

US 2014/0308839 A1 Oct. 16, 2014

(30) Foreign Application Priority Data

Apr. 12, 2013 (JP) ..... 2013-084179

(51) Int. Cl.

| | |
|---|---|
| ***H01R 13/64*** | (2006.01) |
| ***H01R 13/62*** | (2006.01) |
| ***H01R 13/629*** | (2006.01) |
| ***H01R 13/631*** | (2006.01) |
| ***H01R 43/26*** | (2006.01) |
| *H01R 12/71* | (2011.01) |

(Continued)

(52) U.S. Cl.

CPC ..... *H01R 13/62* (2013.01); *H01R 13/629* (2013.01); *H01R 13/631* (2013.01); *H01R 43/26* (2013.01); *H01R 12/716* (2013.01); *H01R 13/4538* (2013.01); *H01R 13/6456* (2013.01)

(58) Field of Classification Search

CPC ..... H01R 13/631
USPC ..... 439/263, 381, 380, 137, 136, 374
See application file for complete search history.

(56) References Cited

U.S. PATENT DOCUMENTS

| | | | | |
|---|---|---|---|---|
| 6,004,140 | A * | 12/1999 | Kato et al. | 439/65 |
| 6,146,184 | A * | 11/2000 | Wilson et al. | 439/374 |
| 6,672,908 | B2 * | 1/2004 | Okabe et al. | 439/682 |

(Continued)

FOREIGN PATENT DOCUMENTS

| | | |
|---|---|---|
| JP | 10-308570 A | 11/1998 |
| JP | 11-144806 A | 5/1999 |

(Continued)

OTHER PUBLICATIONS

Extended European Search Report issued May 14, 2014 in counterpart application No. 14154609.3.

(Continued)

*Primary Examiner* — Phuong Dinh
(74) *Attorney, Agent, or Firm* — Kratz, Quintos & Hanson, LLP

(57) ABSTRACT

After passing through respective contact insertion holes 3A to 3E of a guide connector 3 and penetrating the substrate 110, the contacts 120 are inserted into a female housing 10. After the electrical connection between the contacts 120 and female contacts 20 are respectively established, a slider 1 is pressed down, which causes pressing pins 4 and 5 to press a first movable body 50 and a second movable body 60. With this, a lower stage 50L of the first movable body 50 and a lower stage 60L of the second movable body 60 detach from restriction beams 84 and 85. This allows springs 141 and 142 to extend, to move the first movable body 50 and the second movable body 60 away from the contacts 120.

20 Claims, 20 Drawing Sheets

(51) Int. Cl.
*H01R 13/453* (2006.01)
*H01R 13/645* (2006.01)

(56) References Cited

U.S. PATENT DOCUMENTS

| | | | | |
|---|---|---|---|---|
| 2003/0188882 | A1 | 10/2003 | Asao et al. | |
| 2014/0273603 | A1 * | 9/2014 | Shindo et al. | 439/374 |
| 2014/0308851 | A1 * | 10/2014 | Shindo et al. | 439/625 |

FOREIGN PATENT DOCUMENTS

| | | | |
|---|---|---|---|
| JP | 2010-146873 | A1 | 7/2010 |
| WO | 2009/111567 | A2 | 9/2009 |

OTHER PUBLICATIONS

Extended European Search Report issued Jul. 4, 2014 in counterpart application No. 14164142.3.
Extended European Search Report issued Jul. 4, 2014 in counterpart application No. 14164141.5.

* cited by examiner

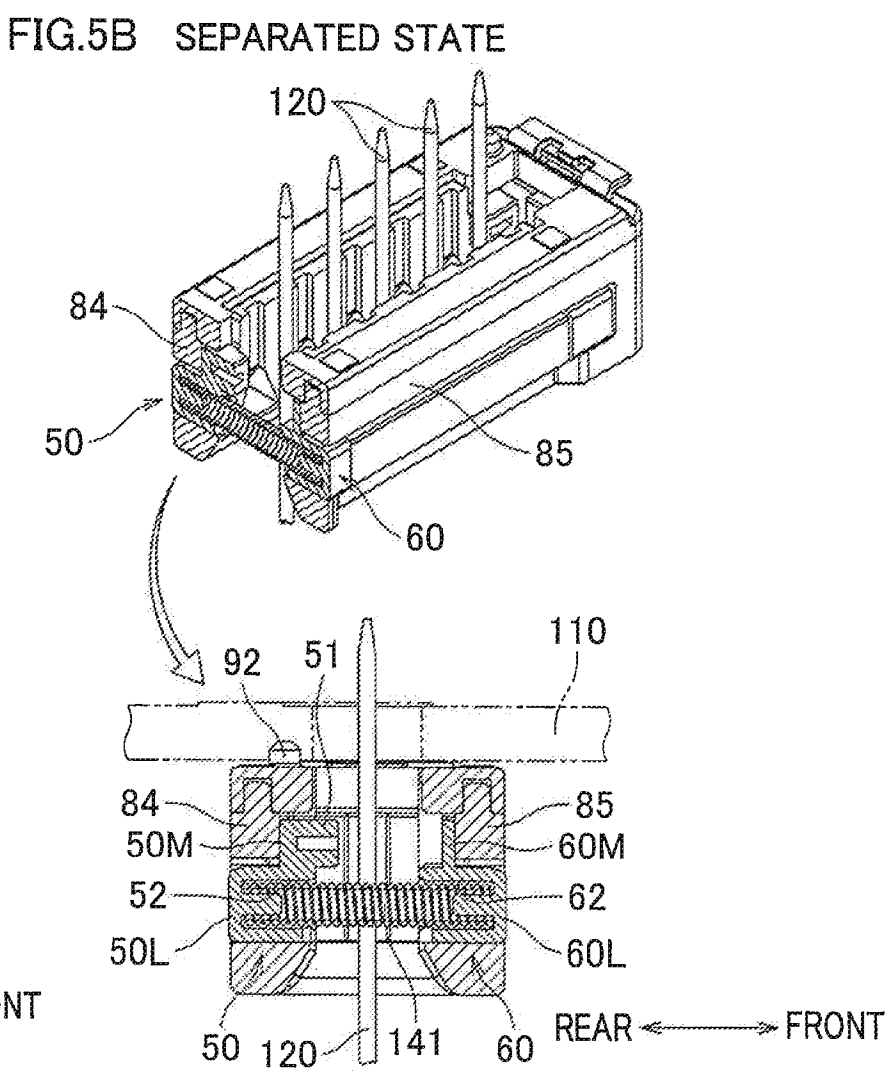
FIG.5B SEPARATED STATE
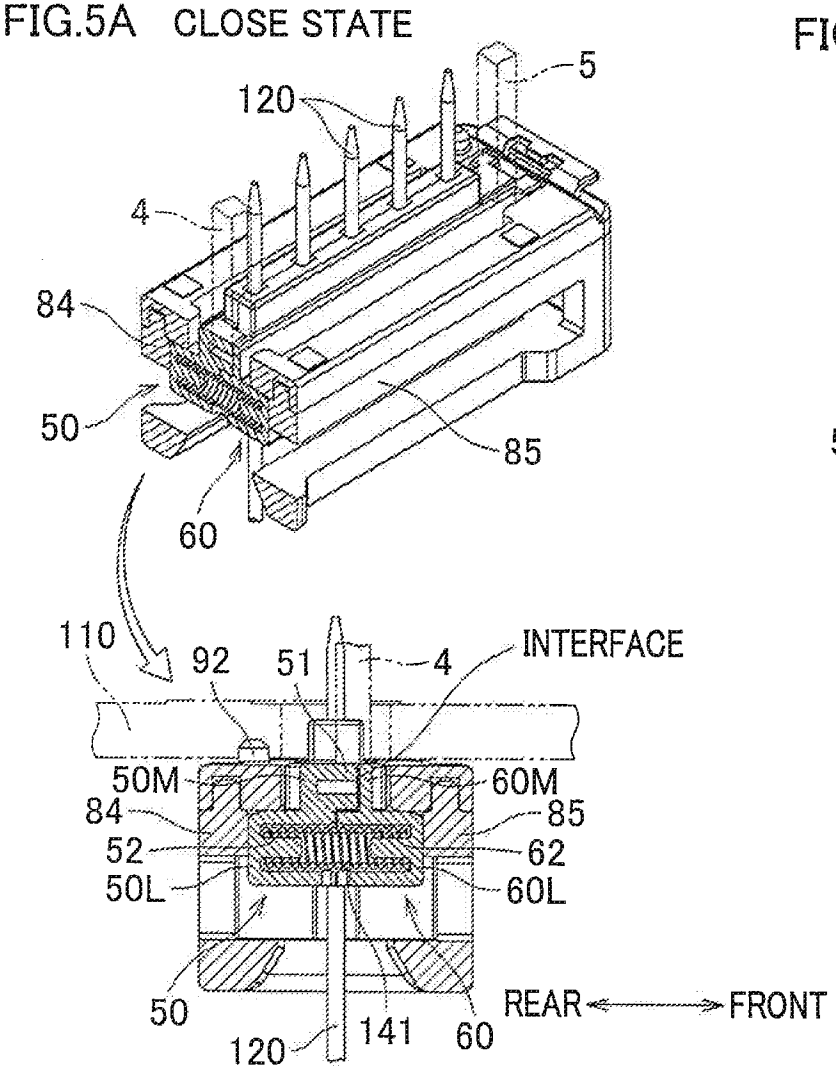
FIG.5A CLOSE STATE

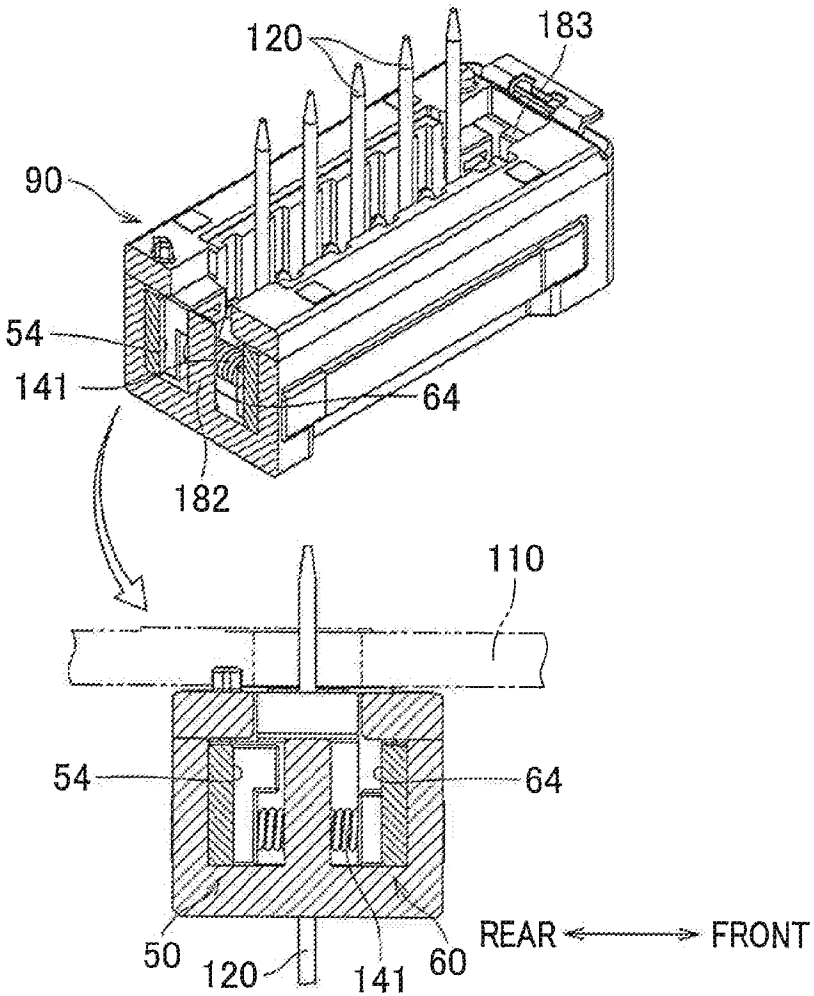
FIG.6B SEPARATED STATE
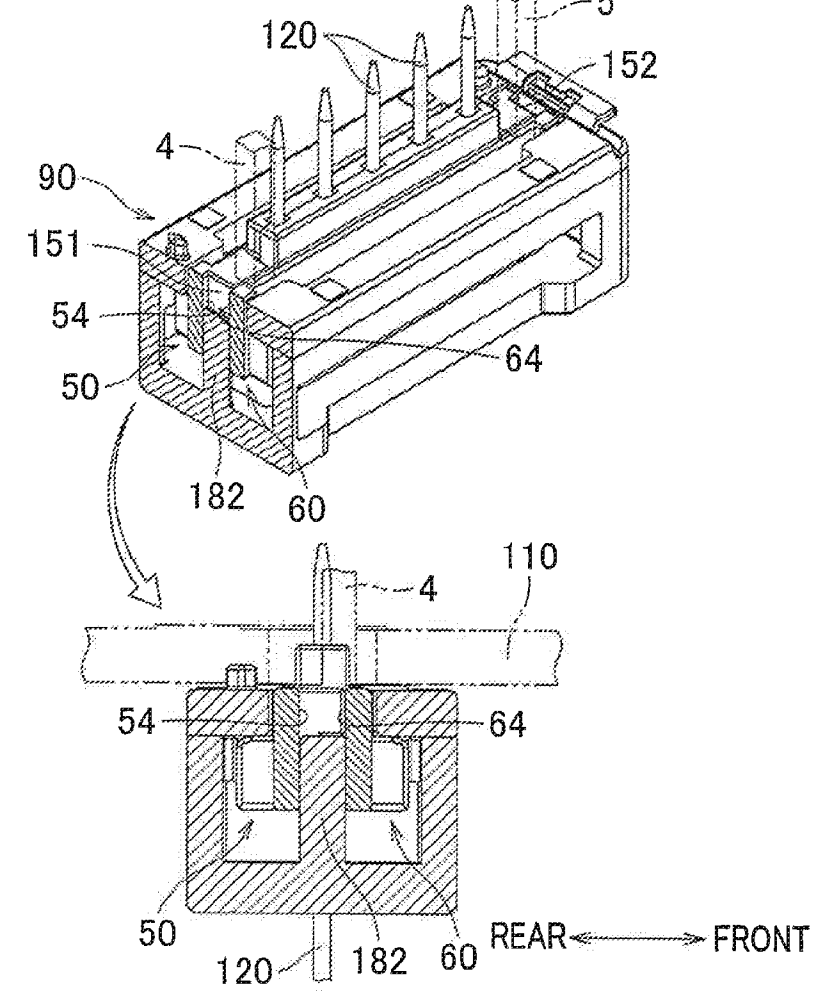
FIG.6A CLOSE STATE 50
60
60L
50L
85
80a
84
80
90
S2
S1
132
131

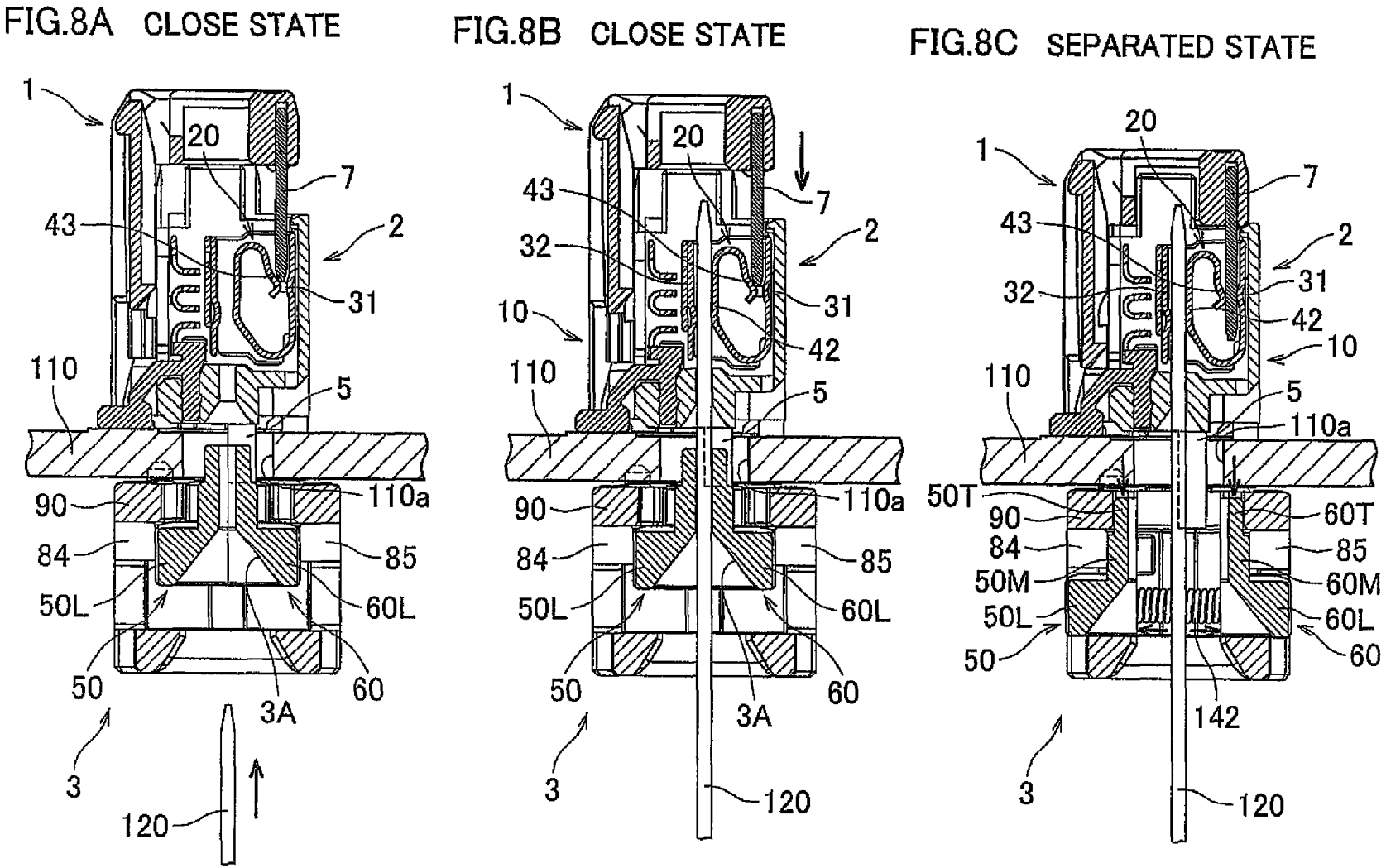
FIG.8A CLOSE STATE
FIG.8B CLOSE STATE
FIG.8C SEPARATED STATE

FIG.13A CLOSE STATE
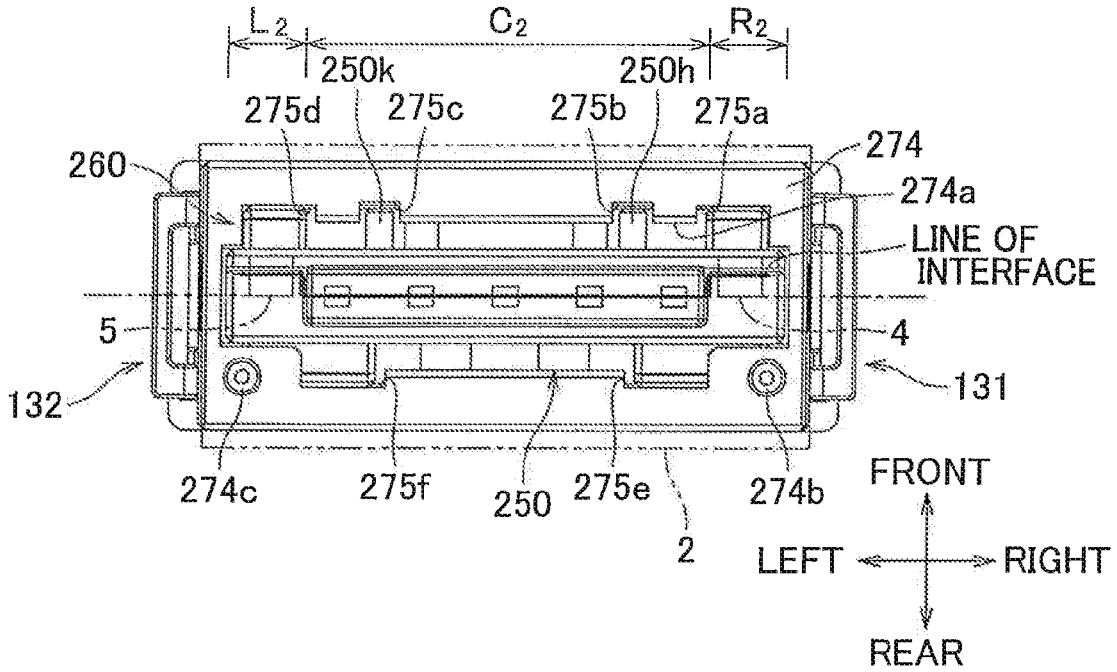
FIG.13B SEPARATED STATE
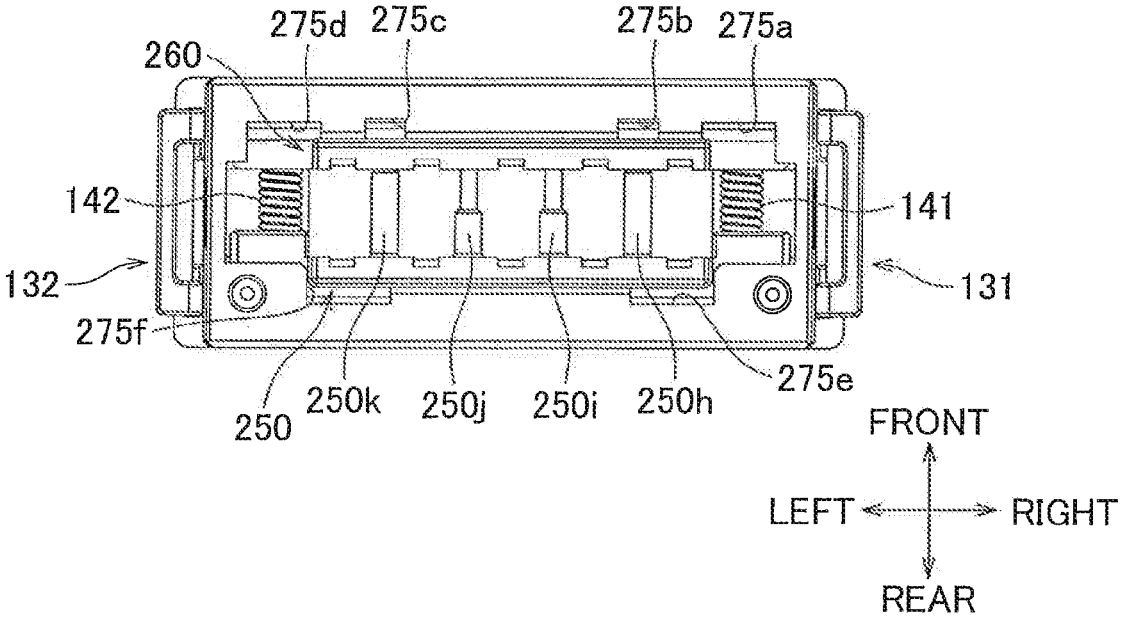

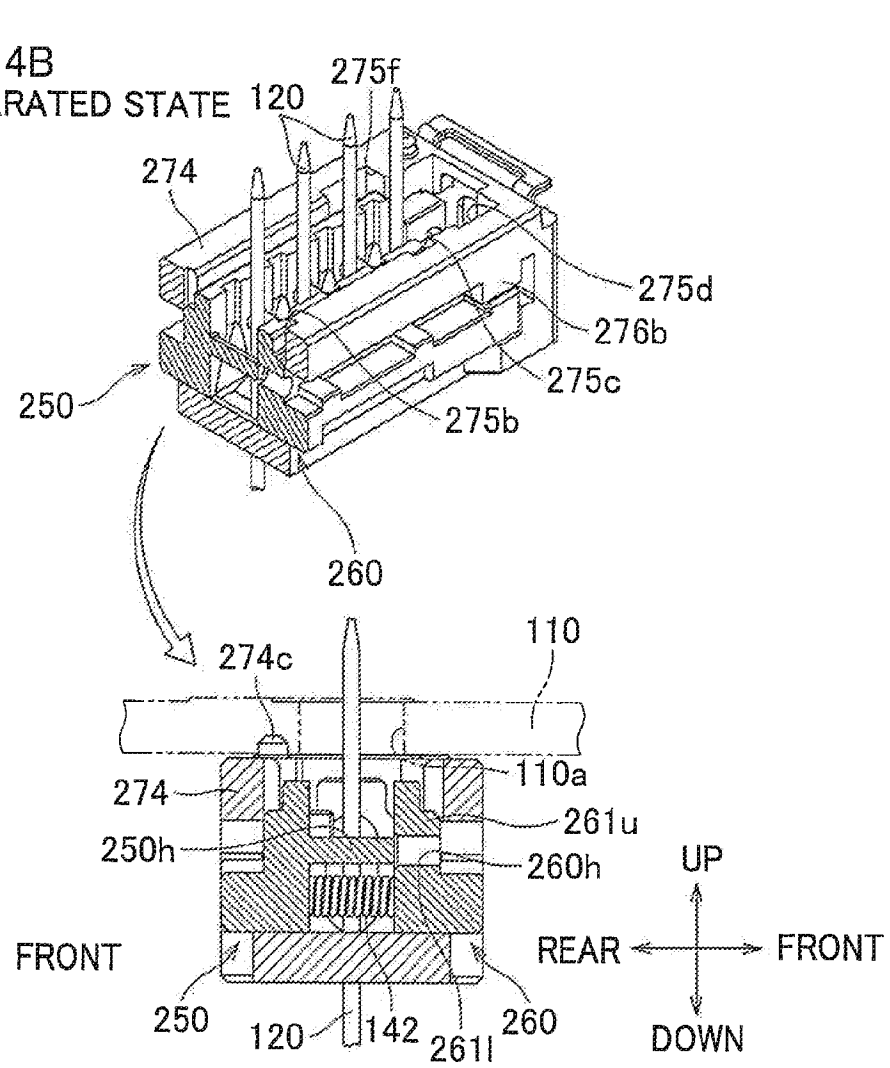
FIG.14B
SEPARATED STATE
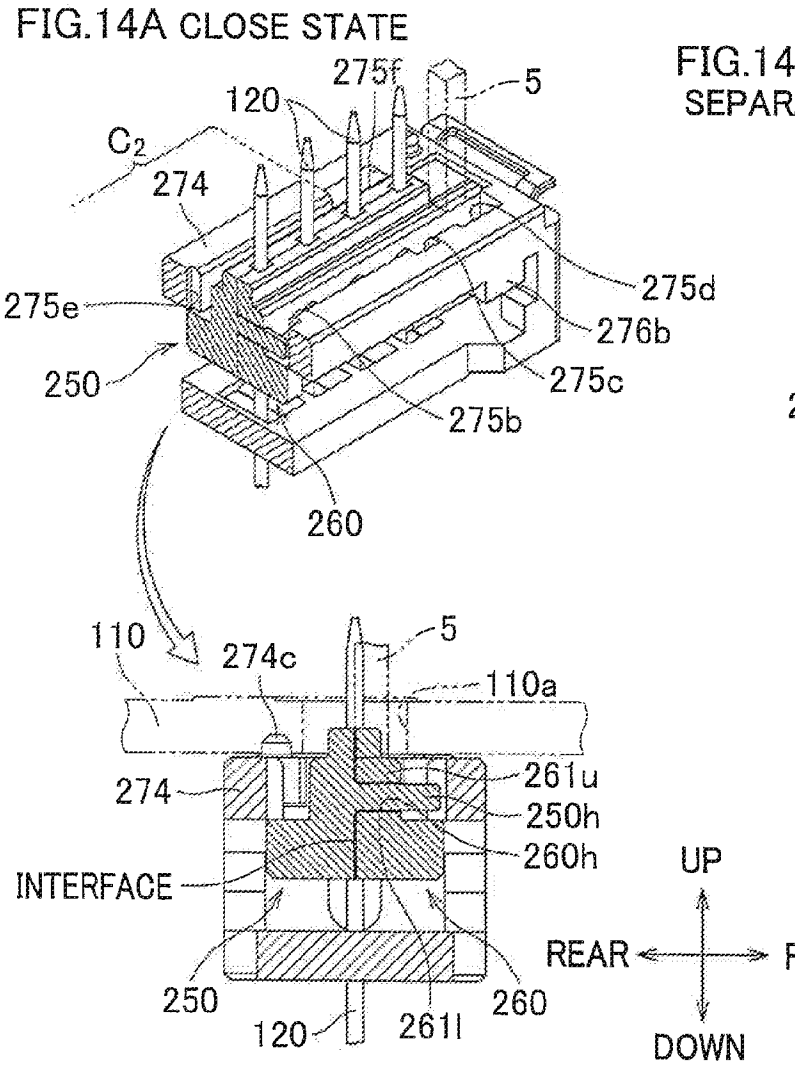
FIG.14A CLOSE STATE

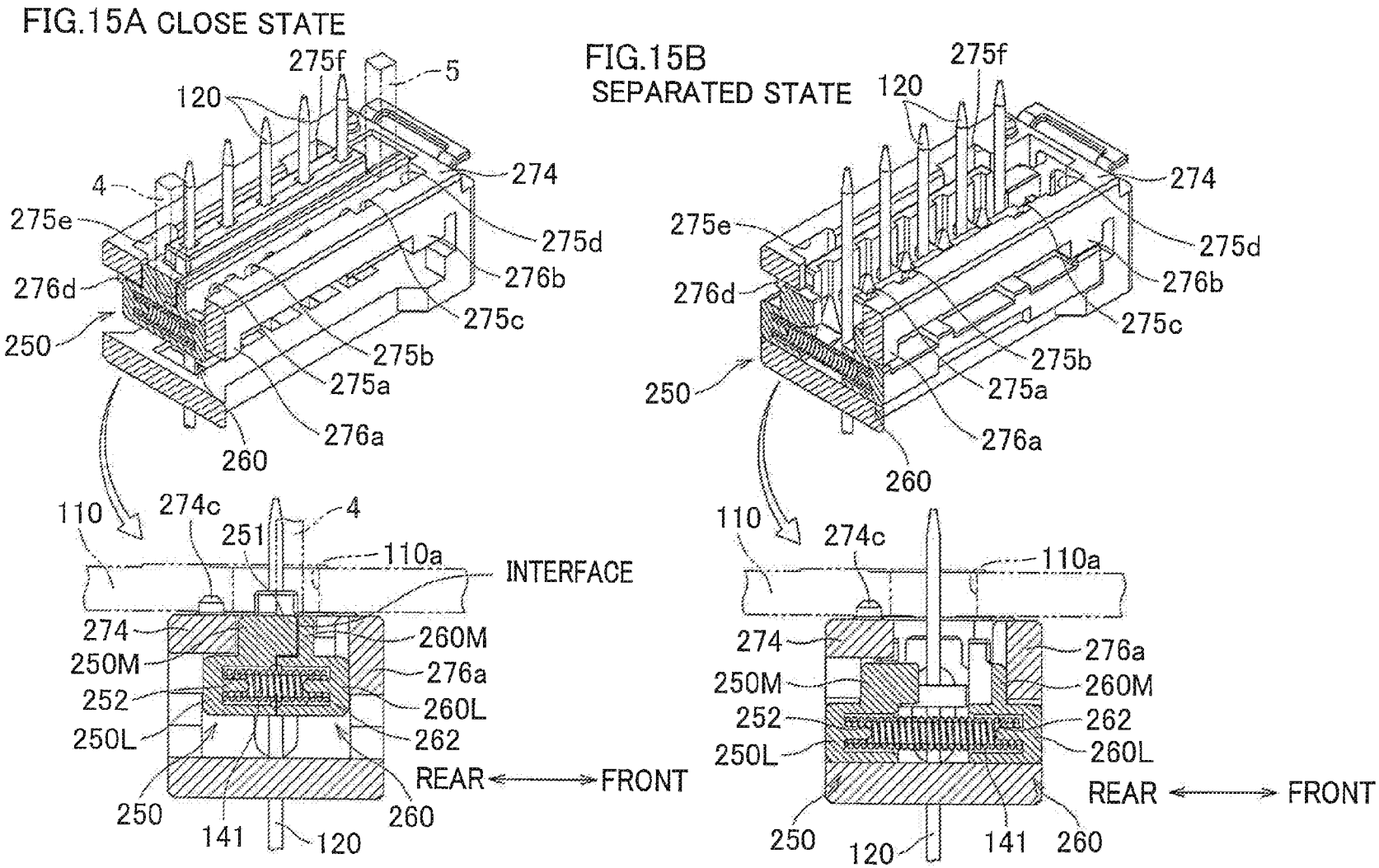
FIG.15A CLOSE STATE
FIG.15B SEPARATED STATE
FRONT
REAR
INTERFACE
5
4
120
275f
274
275d
276b
275c
275b
275a
276a
260
275e
276d
250
110
110a
274c
251
252
250M
250L
260M
260L
262
141

FIG.18A CLOSE STATE
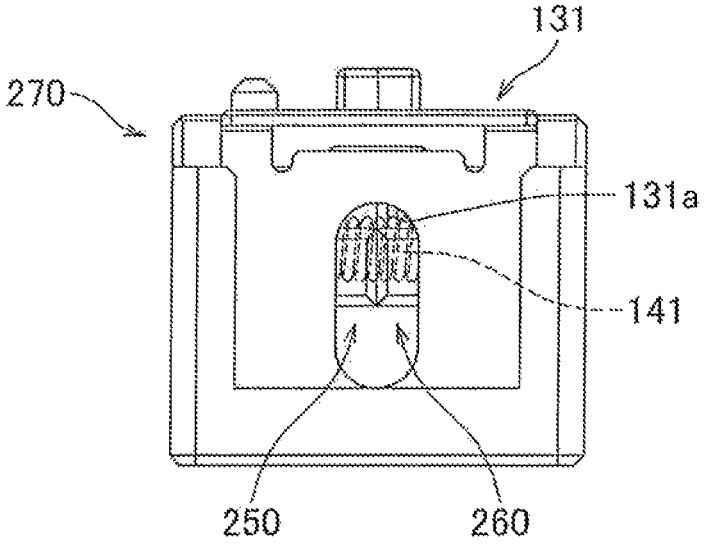
FIG.18B SEPARATED STATE
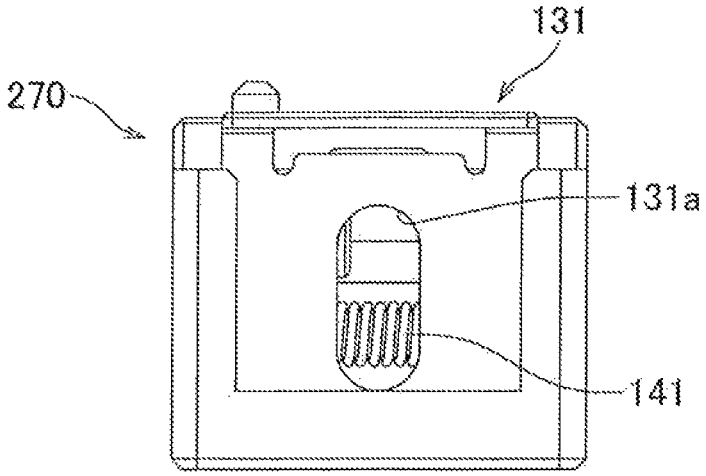

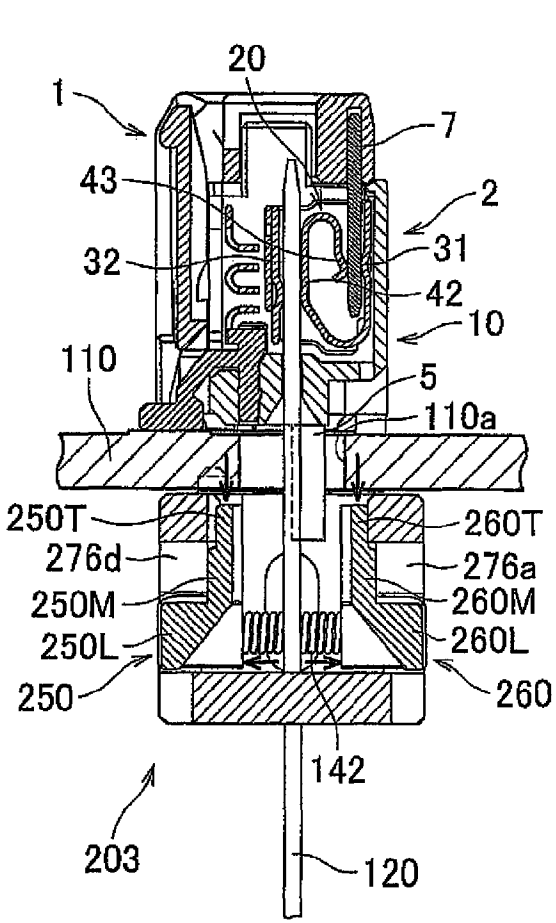
FIG.19C SEPARATED STATE
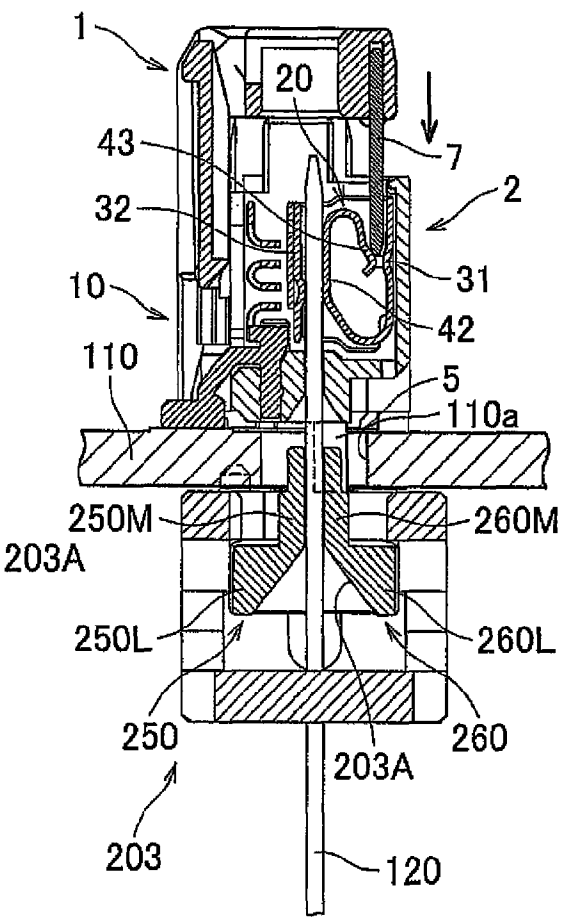
FIG.19B CLOSE STATE
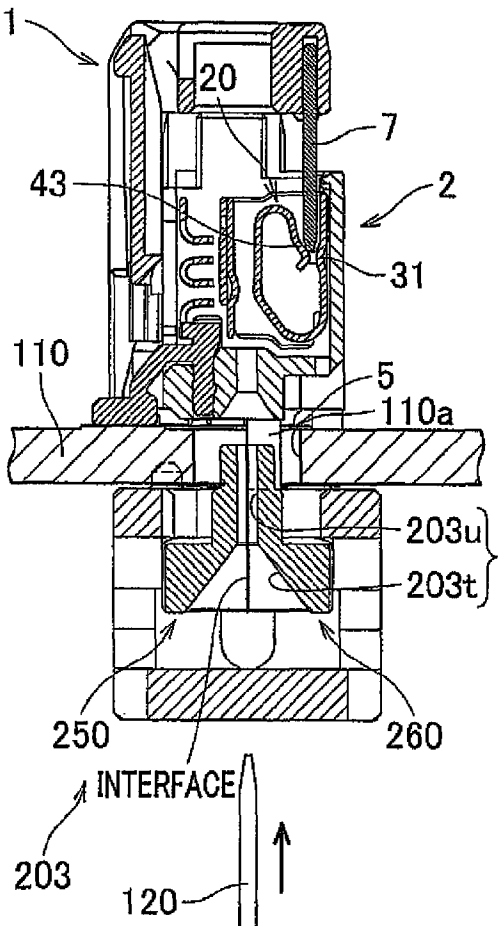
FIG.19A CLOSE STATE

CONNECTOR

CROSS REFERENCE TO RELATED APPLICATION

This application claims priority from Japanese Patent Application No. 2013-084179, which was filed on Apr. 12, 2013, the disclosure of which is herein incorporated by reference in its entirety.

BACKGROUND OF THE INVENTION

1. Field of the Invention

The present invention relates to a connector including a housing configured to guide a contact into a contact insertion hole formed through a substrate.

2. Description of Related Art

As a connector mounted in an automobile or the like, there has been known a connector configured to be placed on a substrate, into which connector a counterpart contact is inserted from below through the substrate. The counterpart contact is inserted into the connector after passing through a contact insertion hole formed through the substrate. If there is misalignment between the counterpart contact and the contact insertion hole due to the tolerance or the like at the time of manufacturing, the counterpart contact cannot be smoothly inserted into the contact insertion hole. Such a problem becomes a more significant concern, with an increase in the number of counterpart contacts.

To address this problem, Japanese Unexamined Patent Publication No. 146873/2010 (Tokukai 2010-146873: Patent Literature 1) discloses a guide housing configured to guide a counterpart contact into a contact insertion hole. The guide housing has a guide hole (through hole) into which the counterpart contact is able to be inserted. When the guide housing is positioned below the substrate, the guide hole is located below the contact insertion hole, and these holes communicate with each other. The guide hole has a funnel-like shape such that its diameter increases with an increase in the distance from the contact insertion hole. The diameter at the lower end of the guide hole is larger than the diameter of the contact insertion hole. Therefore, even if there is misalignment between the counterpart contact and the contact insertion hole due to tolerance or the like at the time of manufacturing, the counterpart contact is inserted into the guide hole, and then guided to the contact insertion hole.

SUMMARY OF THE INVENTION

In the above guide housing, the diameter of the upper end of the guide hole is substantially the same as the diameter of the counterpart contact. This facilitates guiding of the counterpart contact inserted in the guide hole to the contact insertion hole. While the counterpart contact is in the guide hole, the counterpart contact is close to an inner circumferential surface of the guide housing, which surface defines the guide hole.

Areas at or nearby a power supply and a source of power (such as an engine) for an automobile, where a connector is mounted, are likely to be subjected to vibration. This vibration may vibrate the guide housing, which causes the inner circumferential surface of the guide housing to contact the counterpart contact, leading to wear of the counterpart contact. Further, if the substrate is vibrated in addition to the guide housing to cause resonance, the stress to the counterpart contact is increased. As a result, the counterpart contact may be damaged.

In view of the above problem, an object of the present invention is to provide a connector capable of preventing wear of and damage to a counterpart contact.

According to one aspect of the present invention, a connector includes: a first connector and a second connector which are configured to be disposed across a substrate from each other; and a pressing member.

The first connector includes a first housing accommodating first and second movable bodies configured to be located across a first contact from each other, the first contact extending in a direction orthogonal to the substrate, and a biasing member configured to bias the first and second movable bodies in directions away from each other.

The first and second movable bodies accommodated in the first housing are configured to make a transition from a close state to a separated state, the close state being a state in which the first and second movable bodies are biased by the biasing member and movement of the first and second movable bodies in the directions away from each other is restricted by the first housing, the separated state being a state in which the first and second movable bodies are more distant from the second connector than in the close state and the first and second movable bodies are made more distant from each other than in the close state by the biasing member.

The first and second movable bodies define a contact insertion hole in the close state, the contact insertion hole having a smallest diameter not smaller than a diameter of the first contact and including a section whose diameter decreases toward the substrate.

The second connector includes a second housing and a second contact mounted in the second housing, the second contact configured to be electrically connected to the first contact passing through the contact insertion hole and penetrating the substrate.

The pressing member is configured to press at least one of the first and second movable bodies after the first contact passes through the contact insertion hole and penetrates the substrate and the electric connection between the first contact and the second contact is established, thereby to cause the first and second movable bodies to make the transition from the close state to the separated state.

In the first aspect of the present invention, at least one of the first and second movable bodies is pressed after the electric connection between the first contact and the second contact is established, and thereby the two movable bodies are moved away from the first contact. Therefore, even if the first housing is vibrated, or even if the first housing and the substrate are vibrated to cause resonance, wear of and damage to the first contact are prevented.

In the first aspect of the present invention, it is preferable that the first connector further includes a restriction rib disposed between the first and second movable bodies; and the restriction rib is always interposed between the first and second movable bodies during the transition from the close state to the separated state.

In the above structure, rotational movement of the first and second movable bodies is made while the first and second movable bodies are in contact with the restriction rib, and therefore the degrees of the rotation are smaller. Thus, even if the movable bodies rotationally move before being pressed, the two movable bodies are not positionally shifted significantly, and this ensures the transition of the movable bodies to the separated state.

Further, in the above structure, it is preferable that the restriction rib extends in the direction orthogonal to the substrate. This structure ensures restriction of the rotational movement of the first movable body and/or the second movable body before the press.

Additionally, in the above structure, it is preferable that each of surfaces of the first and second movable bodies which surfaces oppose the restriction rib extends in the direction orthogonal to the substrate. Since each of the surfaces of the first and second movable bodies which surfaces oppose the restriction rib extends in the direction orthogonal to the substrate, the rotational movement of the first movable body and/or the second movable body is reliably restricted.

Farther, in the above structure, it is preferable that the first and second movable bodies are configured to be slidable on the restriction rib, and no gap is formed between the first and second movable bodies and the restriction rib. The first and second movable bodies are in contact with the restriction rib, and this ensures restriction of the rotational movement of the first movable body and/or the second movable body.

Further, it is preferable that the restriction rib is provided to the first housing. This ensures the transition of the two movable bodies to the separated state with a simple structure.

Alternatively, in the connector according to the first aspect of the present invention, it is preferable that the first movable body includes a first support surface and a second support surface opposing the first support surface in the direction orthogonal to the substrate, the first support surface and the second support surface create a space therebetween; and that the second movable body includes a projection projecting toward the first movable body and configured to be positioned in the space in the close state.

In this structure, the projection of the second movable body is supported by the first support surface and the second support surface of the first movable body, thereby restricting the rotational movement of the first movable body and/or the second movable body. This prevents the movable bodies from being positionally shifted before being pressed, thereby ensuring the transition of the two movable bodies to the separated state.

In the above structure, it is preferable that the projection is not positioned in the space in the separated state. The two movable bodies are not in contact with each other in the separated state, and this prevents transmission of vibration from one of the movable bodies to the other movable body.

Further, in the above structure, it is preferable that each of the first and second support surfaces is a part of a curved surface defining a hole formed in the first movable body. With a simple structure in which the projection of the second movable body is positioned in the hole of the first movable body, the rotational movement of the first movable body and/or the second movable body is restricted.

Further, it is preferable that at least a part of a line of an interface between the first and second movable bodies is offset from a center with respect to a relative movement direction in which the first and second movable bodies are moved relative to each other, the line being a line of intersection of (i) surfaces of the first and second movable bodies each of which surfaces opposes the pressing member and (ii) the interface between the first and second movable bodies. With this, the two movable bodies are pressed even in the case where the location of the pressing member is offset from the center, and therefore the movable bodies make a transition to the separated state.

Further, in the above structure, it is preferable that, the first movable body and the second movable body partially overlap each other when viewed from the direction orthogonal to the substrate so that a region of intersection of the interface between the first and second movable bodies and the biasing member is positioned substantially at the center with respect to the relative movement direction. The portion of the interface between the two movable bodies which portion intersects the biasing member is positioned substantially at the center, and therefore the biasing member is held by the two movable bodies stably. Further, the biasing member extends in balance in the relative movement direction, and this ensures the transition of the two movable bodies to the separated state.

Alternatively, it is preferable that the first movable body and the second movable body partially overlap each other when viewed from the direction orthogonal to the substrate. When the pressing member presses a portion of one of the movable bodies which portion overlaps the other movable body, the both movable bodies make the transition to the separated state. In this structure, the transition of the both movable bodies to the separated state is possible even when the location of the pressing member is offset from the line of the interface of the two movable bodies. Therefore, flexibility in the location of the pressing member is increased.

According to another aspect of the present invention, a connector includes: a housing accommodating first and second movable bodies configured to be located across a contact from each other, the contact extending in a direction orthogonal to a substrate; a biasing member configured to bias the first and second movable bodies in directions away from each other; and a restriction rib disposed between the first and second movable bodies.

The first and second movable bodies accommodated in the housing are configured to make a transition from a close state to a separated state, the close state being a state in which the first and second movable bodies are biased by the biasing member and movement of the first and second movable bodies in the directions away from each other is restricted by the housing, the separated state being a state in which the first and second movable bodies are made more distant from each other than in the close state by the biasing member.

The first and second movable bodies define a contact insertion hole in the close state, the contact insertion hole having a smallest diameter not smaller than a diameter of the contact and including a section whose diameter decreases toward the substrate.

The restriction rib is always interposed between the first and second movable bodies during the transition from the close state to the separated state.

With this structure, the restriction rib restricts the rotational movement of the first movable body and/or the second movable body, to prevent the movable bodies from being positionally shifted before being pressed. This ensures the transition of the two movable bodies to the separated state.

According to still another aspect of the present invention, a connector includes: a housing accommodating first and second movable bodies configured to be located across a contact from each other, the contact extending in a direction orthogonal to the substrate; and a biasing member configured to bias the first and second movable bodies in directions away from each other.

The first and second movable bodies accommodated in the housing are configured to make a transition from a close state to a separated state, the close state being a state in which the first and second movable bodies are biased by the biasing member and movement of the first and second movable bodies in the directions away from each other is restricted by the housing, the separated state being a state in which the first and second movable bodies are made more distant from each other than in the close state by the biasing member.

The first and second movable bodies define a contact insertion hole in the close state, the contact insertion hole having a smallest diameter not smaller than a diameter of the contact and including a section whose diameter decreases toward the substrate.

The first movable body includes a first support surface and a second support surface opposing the first support surface in the direction orthogonal to the substrate, the first support surface and the second support surface creating a space therebetween.

The second movable body includes a projection projecting toward the first movable body and configured to be positioned in the space in the close state.

In this structure, the projection of the second movable body is supported by the first support surface and/or the second support surface of the first movable body, and this restricts the rotational movement of the first movable body and/or the second movable body. This prevents the movable bodies from being positionally shifted before being pressed, ensuring the transition of the two movable bodies to the separated state.

According to an embodiment of the present invention, after the first contact passes through the contact insertion hole of the first housing and penetrates the substrate, the two movable bodies defining the contact insertion hole are moved away from the first contact. This prevents wear of and damage to the first contact even if the first housing is vibrated, or even if the first housing and the substrate are vibrated to cause resonance.

BRIEF DESCRIPTION OF THE DRAWINGS

FIG. 5A includes a perspective view and a sectional view of the guide connector in a close state. FIG. 5B includes a perspective view and a sectional view of the guide connector in a separated state.

FIG. 6A includes another perspective view and another sectional view of the guide connector in the close state. FIG. 6B includes another perspective view and another sectional view of the guide connector in the separated state.

FIGS. 8A to 8C are sectional views of the connector, showing a sequence of assembling the connector.

FIG. 13A is a plan view of the guide connector shown in FIGS. 10A and 10B, the guide connector being in the close state. FIG. 13B is a plan view of the guide connector shown in FIGS. 10A and 10B, the guide connector being in the separated state.

FIG. 14A includes a perspective view and a sectional view of the guide connector shown in FIGS. 10A and 10B, the guide connector being in the close state. FIG. 14B includes a perspective view and a sectional view of the guide connector shown in FIGS. 10A and 10B, the guide connector being in the separated state.

FIG. 15A includes another perspective view and another sectional view of the guide connector shown in FIGS. 10A and 10B, the guide connector being in the close state. FIG. 15B includes another perspective view and another sectional view of the guide connector shown in FIGS. 10A and 10B, the guide connector being in the separated state.

FIG. 18A is a side view of the guide connector shown in FIGS. 10A and 10B, and the guide connector being in the close state. FIG. 18B is a side view of the guide connector shown in FIG. 10, the guide connector being in the separated state.

FIGS. 19A to 19C are sectional views of a connector of the second embodiment of the present invention, and show a sequence of assembling the connector.

DESCRIPTION OF THE PREFERRED EMBODIMENTS

First Embodiment

The following describes a first embodiment of the present invention.

Figure 1:
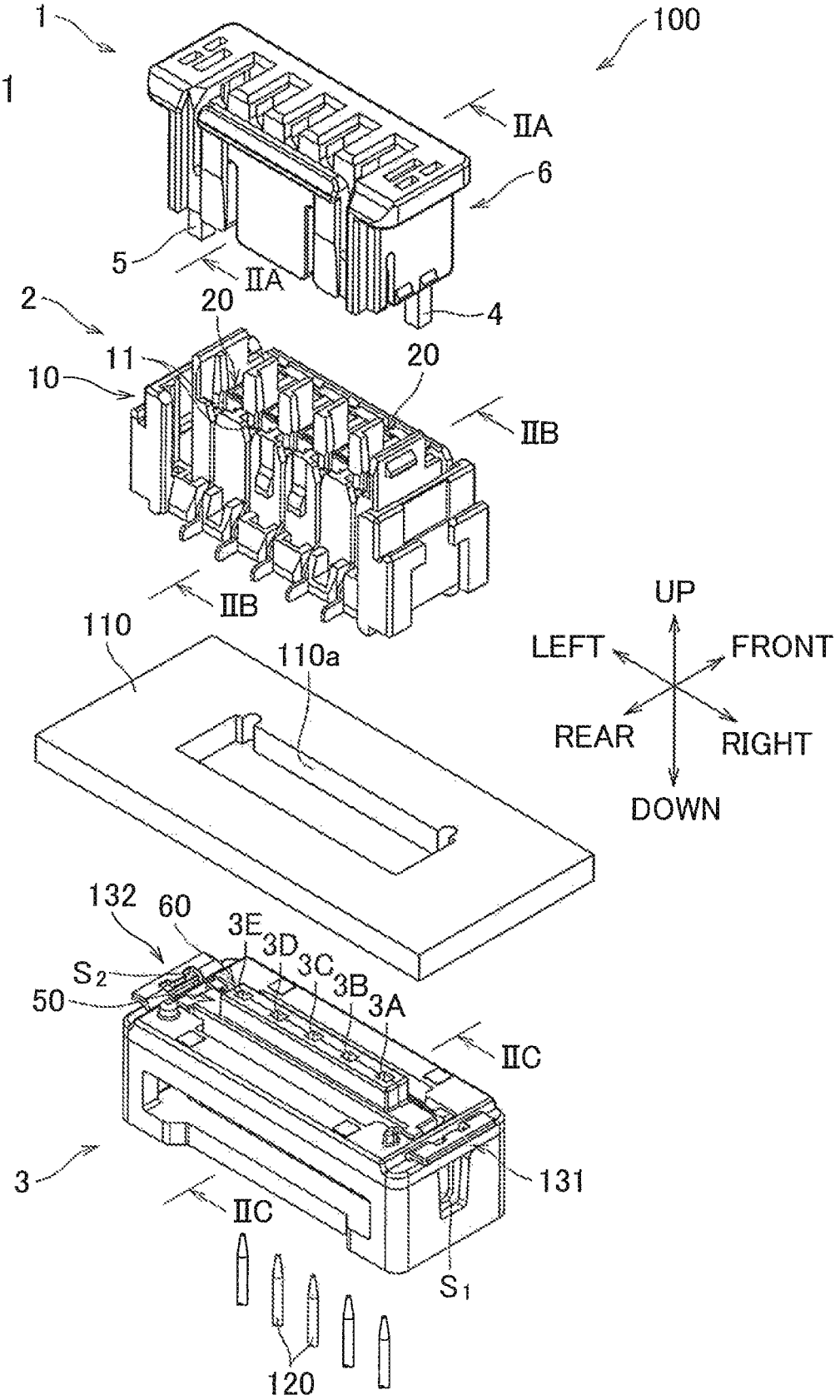
FIG. 1 is an exploded perspective view of a connector of a first embodiment of the present invention.

As shown in FIG. 1, a connector 100 includes a slider 1 and a female connector (a second connector) 2 to be positioned above a substrate 110, and a guide connector (first connector) 3 to be positioned below the substrate 110. Into the guide connector 3, contacts (a first contact) 120 are inserted from below the guide connector 3. The slider 1 includes pressing pins (a pressing member) 4 and 5 each extending in up/down directions. The pressing pins 4 and 5 are respectively attached to right and left end portions of the slider 1.

The substrate 110 has a substantially quadrangular insertion hole 110*a*, which is a through hole in a direction of the thickness of the substrate 110. In the insertion hole 110*a*, an upper end portion of the guide connector 3 is to be positioned (see FIG. 2C).

(Slider)

As shown in FIG. 1, the slider 1 includes a substantially box-shaped housing 6 made of an insulative resin. The pressing pins (pressing member) 4 and 5, each extending in the up/down directions, are respectively attached to right and left end portions of the housing 6. Each of the pressing pins 4 and 5 extends below the lower end of the housing 6. The housing 6 has, in its inside, a space configured to accommodate the female connector 2 (see FIG. 2A).

Figure 2A:
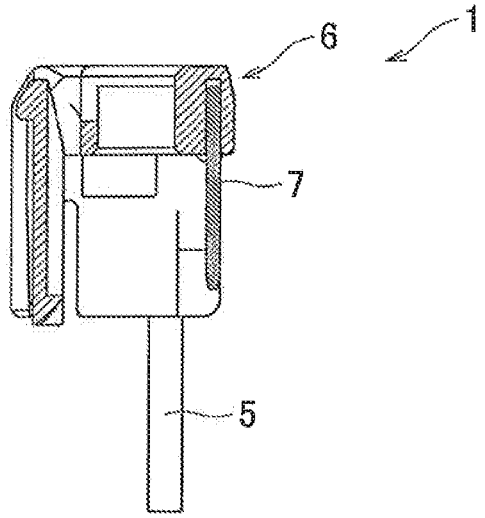
FIG. 2A is a sectional view of a slider taken along the line IIA-IIA of FIG. 1.

As shown in FIG. 2A, long pins 7*a* are mounted in the housing 6. Each of the pins 7 extends in the up/down directions, and configured to be inserted into the female connector 2.

(Female Connector)

Figure 2B:
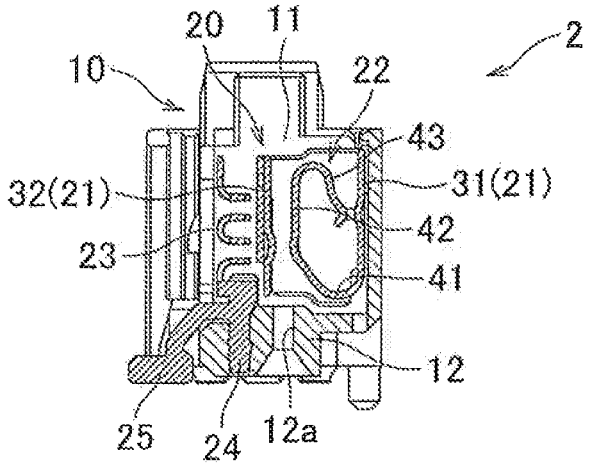
FIG. 2B is a sectional view of a female connector taken along the line IIB-IIB of FIG. 1.

As shown in FIGS. 1 and 2B, the female connector 2 includes: a female housing (a second housing) 10 having a substantially rectangular parallelepiped shape and made of an insulative resin; and five female contacts (a second contact) 20 mounted in the female housing 10.

<Female Housing>

As shown in FIG. 1, the female housing 10 has five accommodation chambers 11 each capable of accommodating a corresponding female contact 20. The five accommodation chambers 11 are aligned in left/right directions.

As shown in FIG. 2B, the female housing 10 has a bottom wall 12, which is perforated in the up/down directions to form through holes 12*a*. The through holes 12*a* are formed below the respective accommodation chambers 11, and communicate with the respective accommodation chambers 11. Each contact 120 having penetrated the substrate 110 is inserted into the corresponding through hole 12*a* from below. After passing through the through hole 12*a*, each contact 120 is inserted into the corresponding accommodation chamber 11.

Each through hole 12*a* includes an upper portion having a constant diameter, and a lower portion having a varying diameter. The lower portion is tapered so that its diameter increases with an increase in the distance from the upper portion. Such a structure facilitates insertion of each contact 120 into the corresponding accommodation chamber 11.

<Female Contact>

As shown in FIGS. 1 and 2B, each female contact 20 includes: a polyangular tubular portion 21 whose upper and lower ends are opened; a bent portion 22 bent to extend around the inner periphery of the polyangular tubular portion 21; an elastic portion 23 configured to be elastically displaced, e.g., in the up/down directions; and a fixed portion 24 and a mounting portion 25 which are located outside the accommodation chamber 11 (see FIG. 2B). The fixed portion 24 extends downward from the lower end of the elastic portion 23. The fixed portion 24 is fixed to the bottom wall 12 of the female housing 10. The mounting portion 25 extends obliquely downward from a midway portion of the fixed portion 24. The mounting portion 25 is to be soldered to the substrate 110.

As shown in FIG, 2B, the polyangular tubular portion 21 includes a front wall portion 31 and back wall portion 32 opposing each other in front/rear directions. Each of the front wall portion 31 and the back wall portion 32 has a protruding portion protruding in a direction toward the opposed wall portion.

The bent portion 22 includes: a lower curved portion 41 extending from the lower end of the front wall portion 31 and curved to form a downward projection; a straight portion 42 extending upward from one end of the lower curved portion 41; and a projecting portion 43 extending from one end of the straight portion 42 while forming a projection toward the front wail portion 31. Between the protruding portion of the front wail portion 31 and the projecting portion 43 is inserted the corresponding pin 7 of the slider 1 (see FIG. 8C). Meanwhile, between the protruding portion of the back wall portion 32 and the straight portion 42 is inserted the corresponding contact 120 (see FIG. 8B).

(Guide Connector)

Figure 2C:
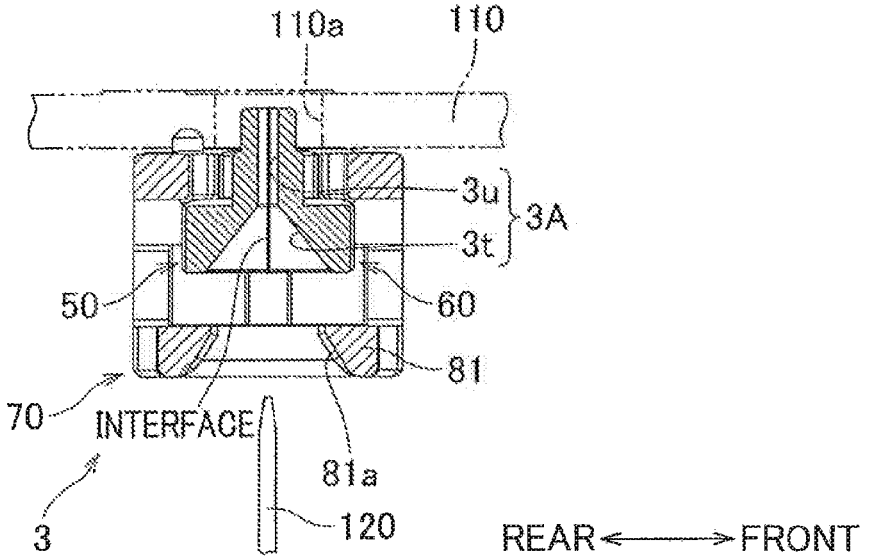
FIG. 2C is a sectional view of a substrate and a guide connector, taken along the line IIC-IIC of FIG. 1.
Figure 3:
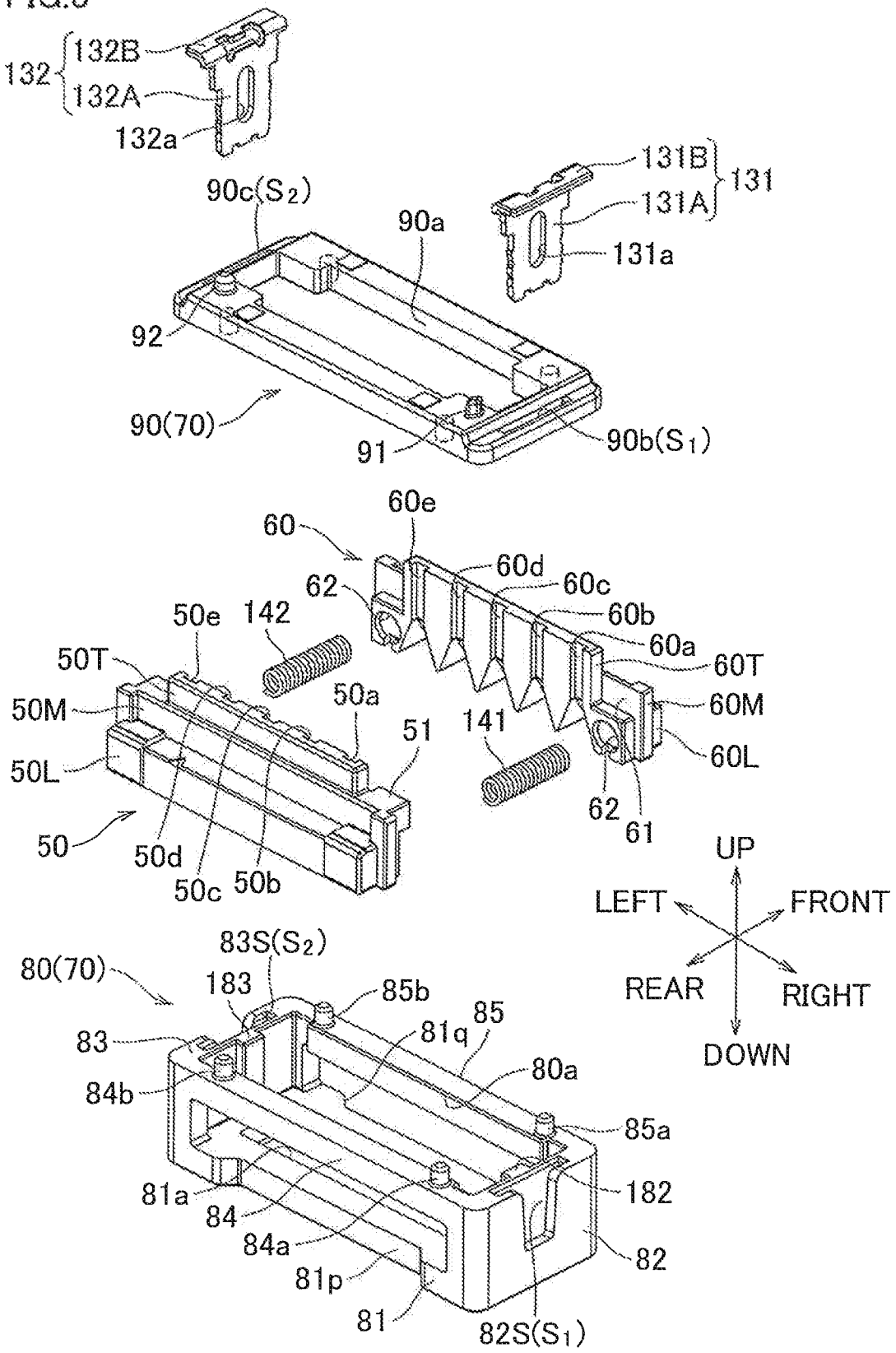
FIG. 3 is an exploded perspective view of the guide connector.

As shown in FIGS. 2C and 3, the guide connector 3 includes a first movable body 50 (rear movable body) and a second movable body 60 (front movable body) opposing each other in the front/rear directions, and a substantially box-shaped housing (a first housing) 70 accommodating these movable bodies. As shown in FIG. 3, the housing 70 includes: a box (a first accommodating member) 80 having an open upper end; and a lid (a second accommodating member) 90 disposed on the box-like body 80 so as to partially close the open upper end. The box-like body 80 and the lid 90 are separable from each other in the up/down directions. Further, the housing 70 has slits $S_1$ and $S_2$ at right and left end portions of the housing 70, respectively. Each of the slits $S_1$ and $S_2$ is formed across the box-like body 80 and the lid 90. Into the slits $S_1$ and $S_2$, strengthening tabs 131 and 132 are respectively inserted (see FIG. 1). The first movable body 50, the second movable body 60, the housing 70, and the strengthening tabs 131 and 132 are all made of an insulative resin.

As shown in FIG. 3, two springs (a biasing member) 141 and 142 are disposed between the first movable body 50 and the second movable body 60. One of the springs (biasing member) 141 is disposed between respective right end portions of the two movable bodies 50 and 60, while the other spring (biasing member) 142 is disposed between respective left end portions of the two movable bodies 50 and 60.

Each of the springs 141 and 142 is elastically deformable in the front/rear directions, and biases the first movable body 50 and the second movable body 60 in directions away from each other. The first movable body 50 and the second movable body 60 are thus biased so as to move in the directions away from each other. In the housing 70, the movable bodies are configured to make a transition from a close state (see FIGS. 5A, 6A, 9A, and 9B), in which the movement of the movable bodies in the directions away from each other is restricted by the housing 70, to a separated state (see FIGS. 5B, 6B, and 9C), in which the movable bodies are mere distant from each other than in the close state. In the close state, the respective surfaces of the first movable body 50 and the second movable body 60 which surfaces oppose each other (hereinafter the "opposing surfaces") are in contact with each other (see FIGS. 5A, 9A, and 9B). In the separated state, as the springs 141 and 142 further extend in the front/rear directions than in the close state, the first movable body 50 and the second movable body 60 are more distant from each other (see FIGS. 5B and 9C). Note that in FIGS. 5B and 6B, the pressing pins 4 and 5 are not illustrated.

Figure 4A:
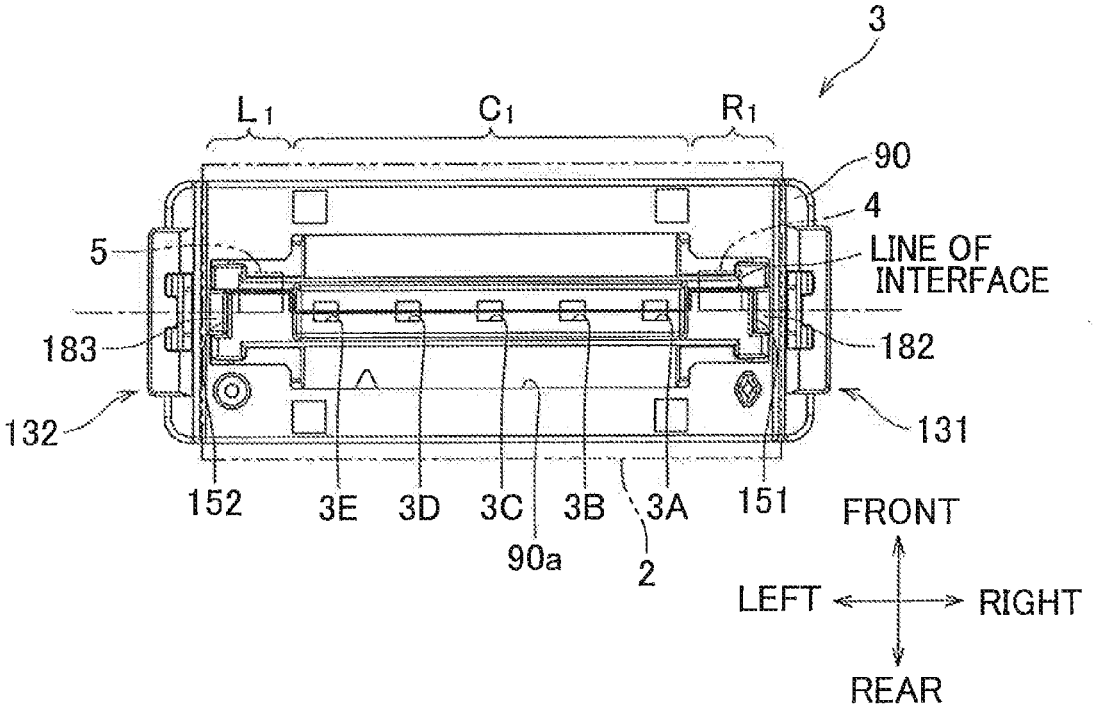
FIG. 4A is a plan view of the guide connector.

As shown in FIG. 3, each of the first movable body 50 and the second movable body 60 has a side portion of a stairway-like shape on the opposite side of the body from the surface opposing the counterpart. The stairway-like side portion has three stages (an upper stage 50T, a middle stage 50M, and a lower stage 50L of the first movable body 50; and an upper stage 60T, a middle stage 60M, and a lower stage 60L of the second movable body 60). The first movable body 50 and the second movable body 60 have substantially the same structure except that of the right and left end portions. In this embodiment, as shown in FIG. 4A, the section constituted by the right end portions of the two movable bodies 50 and 60 is referred to as a right end section $R_1$, the section constituted by the left end portions of the movable bodies 50 and 60 is referred to as a left end section $L_1$, and the section between the right end section $R_1$ and the left end section $L_1$ is referred to as a central section $C_1$. The central section $C_1$ is shaped to have three stages which are the upper stage, the middle stage, and the lower stage. Each of the right end section $R_1$ and the left end section $L_1$ is shaped to have two stages which are the middle stage and the lower stage (see FIG. 3). Above the right end section $R_1$ and the left end section $L_1$, the pressing pins 4 and 5 are supposed to be positioned, respectively.

<Central Section $C_1$>

As shown in FIG. 3, the first movable body 50 has, on its surface opposing the second movable body 60, five recesses 50*a*, 50*b*, 50*c*, 50*d*, and 50*e* aligned in the left/right directions. The second movable body 60 has, on its surface opposing the first movable body 50, five recesses 60*a*, 60*b*, 60*c*, 60*d*, and 60*e* aligned in the left/right directions. These recesses are formed so that the recesses of the first movable body 50 respectively oppose the recesses of the second movable body 60 with respect to the front/rear directions. In the close state, each recess of the first movable body and a corresponding recess of the second movable body, which recesses oppose each other in the front/rear directions (e.g., the recess 50*a* of the first movable body 50 and the recess 60*a* of the second movable body 60) form one contact insertion hole (e.g., a contact insertion hole 3A) (see FIGS. 1, 4A, and 4B). Thus, the opposing surfaces of the first movable body 50 and the second movable body 60 define five contact insertion holes 3A, 3B, 3C, 3D, and 3E (see FIG. 1).

Into the contact insertion holes 3A, 3B, 3C, 3D, and 3E, contacts 120 each extending in the up/down directions are respectively inserted from below (see FIGS. 1 and 2C). While the contacts 120 are inserted, the first movable body 50 and the second movable body 60 are opposed to each other with the contacts 120 interposed therebetween (see FIG. 6B).

As shown in FIG. 2C, the contact insertion hole 3A includes an upper section 3*u* whose diameter is constant, and a tapered section 3*t* whose diameter varies to form a tapered shape. The tapered section 3*t* is located below the upper section 3*u*. The tapered section 3*t* is tapered down toward the upper section 3*u*. The upper section 3*u* and the upper end of the tapered section 3*t* have the smallest diameter of the contact insertion hole 3A. The smallest diameter is not smaller than the diameter of each contact 120. Note that each of the contact insertion holes 3B to 3E has the same structure as that of the contact insertion hole 3A.

As shown in FIG. 2C, in the central section $C_1$, the interface between the first movable body 50 and the second movable body 60 is located substantially at the center with respect to the front/rear directions across its length from the upper end to the lower end (see FIG. 4A). Note that the "front/rear directions" are the directions in which the first movable body 50 and the second movable body 60 are moved relative to each other by the springs 141 and 142.

<Right End Section $R_1$, Left End Section $L_1$>

In the right end section $R_1$, the middle stage 50M of the first movable body 50 is provided with a projection 51 projecting toward the second movable body 60, as shown in FIG. 3. On the other hand, the middle stage 60M of the second movable body 60 has a dent 61 capable of receiving the projection 51. Because of this configuration, in the close state, the interface between the middle stage 50M of the first movable body 50 and the middle stage 60M of the second movable body 60 is offset toward the front from the center with respect to the front/rear directions, as shown in FIG. 5A. On the other hand, the interface between the lower stage 50L of the first movable body 50 and the lower stage 60L of the second movable body 60 is located substantially at the center with respect to the front/rear directions. Further, the projection 51 of the first movable body 50 overlaps the lower stage 60L of the second movable body 60 when viewed from the up/down directions.

The lower stages 50L and 60L accommodate the spring 141. In the lower stages 50L and 60L, the spring 141 intersects the interface between the two movable bodies 50 and 60. A part of the spring 141 is located in a hole 52 of the first movable body 50, and another part of the spring 141 is located in a hole 62 of the second movable body 60. The holes 52 and 62 oppose each other in the front/rear directions, and have substantially the same size. Therefore, in the close state, the rear half of the spring 141 is located in the hole 52, and the front half of the spring 141 is located in the hole 62. Thus, the spring 141 is held by the first movable body 50 and the second movable body 60 substantially equally. When the first movable body 50 and the second movable body 60 are released, the spring 141 extends toward the front and the back equally, as shown in FIG. 5B.

As shown in FIG. 4A, in the close state, a recess 151 opening to the right end of the housing 70 is formed in the right, end section $R_1$. As shown in FIG. 6A, the recess 151 extends from the upper ends to the lower ends of the first movable body 50 and the second movable body 60.

In the recess 151, a restriction rib 182 of the housing 70 is positioned. The restriction rib 182 is sandwiched by the first movable body 50 and the second movable body 60 in the front/rear directions. A surface 54 of the first movable body 50 which surface opposes the restriction rib 182 in the front/rear directions and a surface 64 of the second movable body 60 which surface opposes the restriction rib 182 in the front/rear directions extend in the up/down directions.

Figure 4B:
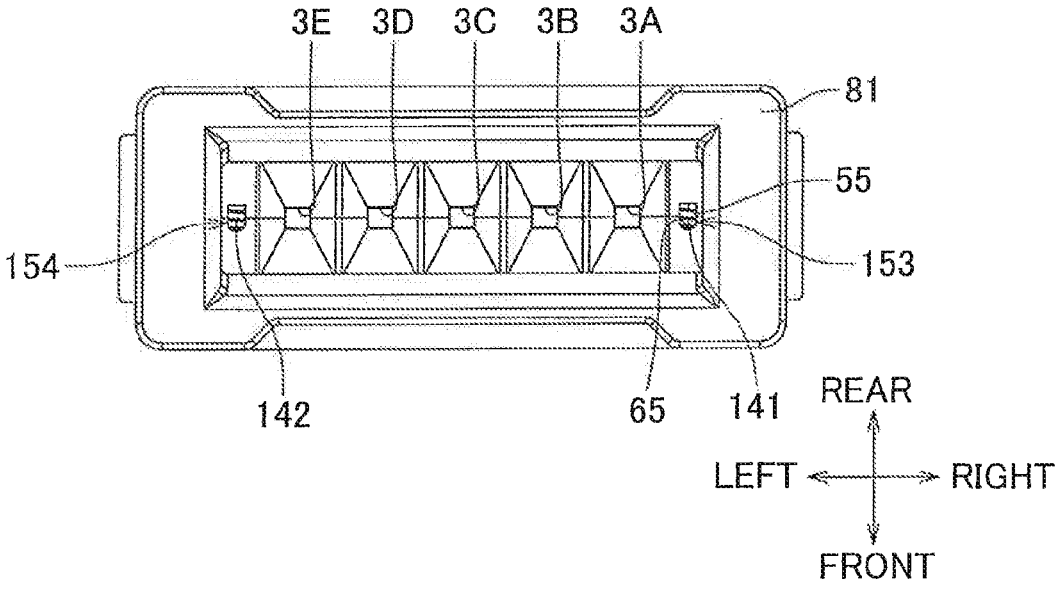
FIG. 4B is a bottom view of the guide connector.

As shown in FIG. 4B, at the bottom of the first movable body 50 and the bottom of the second movable body 60, there are respectively formed recesses 55 and 65 opposing each other in the front/rear directions. The recesses 55 and 65 are respectively in communication with the holes 52 and 62 in which the spring 141 is disposed. In the close state, the two recesses 55 and 65 are combined, to form a window 153 through which the spring 141 in the holes 52 and 62 is visible. This makes it possible to check the presence/absence of the spring 141 when looking at the bottom of the guide connector 3. In a plan view, the recess 55 has a quadrangular shape, while the recess 65 has a semi oval shape. The different shapes of the recess 55 and the recess 65 show which is the first movable body 50 or the second movable body 60 between the two bodies.

The left end section $L_1$ has substantially the same structure as that of the right end section $R_1$. Also in the left end section $L_1$, in the close state, the interface between the respective middle stages of the first movable body 50 and the second movable body 60 is offset toward the front from the center with respect to the front/rear directions, while the interface between the respective lower stages of the first movable body 50 and the second movable body 60 is located substantially at the center with respect to the front/rear directions, as shown in FIG. 5A. The two movable bodies 50 and 60 partially overlap each other when viewed from the up/down directions. In this embodiment, the pressing pin 5 is fixed so as to be located above the overlapping portion (see FIG. 4A). Further, as shown in FIG, 4A, a recess 152 opening to the left end of the housing 70 is formed in the left end section $L_1$. In the recess 152, the restriction rib 183 is positioned. A surface of the first movable body 50 which surface opposes the restriction rib 183 in the front/rear directions and a surface of the second movable body 60 which surface opposes the restriction rib 183 in the front/rear directions extend in the up/down directions. Further, at the bottom of the left end section $L_1$, there is formed a window 154 through which the spring 142 is visible, as shown in FIG. 4B.

Referring back to FIG. 4A, in the close state, the line of the interface between first movable body 50 and the second movable body 60 which line is on the top surface of the guide connector 3 is located substantially at the center with respect to the front/rear directions in the central section $C_1$, while the line of the interface is offset toward the front from the center with respect to the front/rear directions in the right end section $R_1$ and the left end section $L_1$.

[Housing]

<Box-Like Body>

As shown in FIG. 3, the box-like body 80 of the housing 70 includes: a bottom wall 81; a right wall 82; a left wall 83; and two restriction beams 84 and 85 each extending from the upper end of the right wall 82 to the upper end of the left wall 83. There is a space between the bottom wall 81 and each of the restriction beams 84 and 85. The box-like body 80 has an upper end portion having an opening 80*a* defined by the right wall 82, the left wall 83, and the restriction beams 84 and 85. The opening 80*a* is sized so that the lower stages 50L and 60L of the two movable bodies 50 and 60 in the close state can be disposed at the same time in the opening 80*a* from above (see FIG. 7A).

The bottom wall 81 has recesses 81*p* and 81*q* respectively formed at side portions of the bottom wall 81. The recesses 81*p* and 81*q* make it easier to pinch the bottom wall 81 with respect to the front/rear directions. This facilitates the movement of the guide connector 3 to the position below the substrate 110. Further, the bottom wall 81 has an opening 81*a*. As shown in FIG. 2C, the size of the opening 81*a* decreases toward the upper end of the opening 81*a*.

Referring back to FIG. 3, the right wall 82 and the left wall 83 respectively have slits 82S and 83S, each extending in the up/down directions. Into the slits 82S and 83S, the strengthening tabs 131 and 132 are respectively inserted.

At a middle portion of the right wall 82 with respect to the front/rear directions, there is provided a restriction rib 182 protruding toward the left wall 83. Likewise, at a middle portion of the left wall 83 with respect to the front/rear directions, there is provided a restriction rib 183 protruding toward the right wall 82.

Each of the restriction ribs 182 and 183 extends in the up/down directions from the upper end to the lower end of corresponding one of the right wall 82 and the left wall 83 (see FIGS. 6A and 6B). During the transition from the close state to the separated state, the restriction ribs 182 and 183 are always interposed between the first movable body 50 and the second movable body 60, and the restriction ribs 182 and 183 are configured to be slidable on the surfaces 54 and 64 of the two movable bodies 50 and 60. In the close state, the restriction ribs 182 and 181 are in contact with the first movable body 50 and the second movable body 60, and there is hardly any gap between the ribs and the bodies (see FIG. 6A).

The restriction beams 84 and 85 of the box-like body 80 shown in FIG. 3 restrict the movement of the two movable bodies 50 and 60 in the directions away from each other (see FIGS. 5A and 5B). In the close state, as shown in FIG. 5A, the lower stage 50L of the first movable body 50 and the lower stage 60L of the second movable body 60 are respectively in contact with the restriction beams 84 and 85. Meanwhile, in the separated state, as shown in FIG. 5B, the middle stage 50M of the first movable body 50 and the middle stage 60M of the second movable body 60 are respectively in contact with the restriction beams 84 and 85.

As shown in FIG. 3, the restriction beam 84 is provided with, on its top surface (the surface opposing the lid 90), bosses (protrusions) 84*a* and 84*b* respectively formed at its right and left end portions. The restriction beam 85 is also provided with, on its top surface (the surface opposing the lid 90), bosses (protrusions) 85*a* and 85*b* respectively formed at its right and left end portions. The bosses 84*a*, 84*b*, 85*a*, and 85*b* are fitted into four holes formed on an under surface of the lid 90.

<Lid>

As shown in FIG. 3, the lid 90 has an opening 90*a*. The opening 90*a* is smaller than the opening 80*a* of the box-like body 80. The opening 90*a* is sized so that the upper stages and the middle stages of the first movable body 50 and the second movable body 60 are visible through the opening 90*a* while the movable bodies are in the close state (see FIG. 4A). At the right and left of the opening 90*a*, there are respectively formed tab receiving holes 90*b* and 90*c* into which the strengthening tabs 131 and 132 are respectively inserted.

The tab receiving hole 90*b* and the slit 82S of the box-like body 80 form the slit $S_1$ of the housing 70 (see FIG. 1). The tab receiving hole 90*c* and the slit 83S of the box-like body 80 form the slit $S_2$ of the housing 70.

Referring back to FIG. 3, the lid 90 is provided with bosses 91 and 92 on its top surface. The bosses 91 and 92 are configured to be fitted into holes (not shown) formed on a lower surface of the substrate 110 (see FIGS. 5A and 5B). The shapes of the two bosses 91 and 92 are different from each other, and the shapes of the holes into which the bosses 91 and 92 are respectively fitted are also different from each other. Therefore, if the guide connector 3 is positioned the wrong way around (for example, in the opposite way with respect to the left/right directions), the bosses 91 and 92 are not fitted in the holes of the substrate 110. This structure prevents the guide connector 3 from being positioned the wrong way around.

<Strengthening Tab>

As shown in FIG. 3, each of the strengthening tabs 131 and 132 is a substantially quadranuglar plate-like member, and includes a plate portion 131A, 132A extending in the up/down directions, and a horizontal portion 131B, 132B extending from the upper end of the plate portion 131A, 132A in a direction away from the housing 70. The plate portions 131A and 132A respectively have, at respective central portions, through holes 131*a* and 132*a* each of which has a long hole shape. The horizontal portions 131B and 132B are to be soldered to the lower surface of the substrate 110, to enhance the strength of the connection between the guide connector 3 and the substrate 110.

Now, a process of assembling the guide connector 3 will be described, with reference to FIGS. 7A to 7D.

Figures 7A, 7B, 7C, 7D:
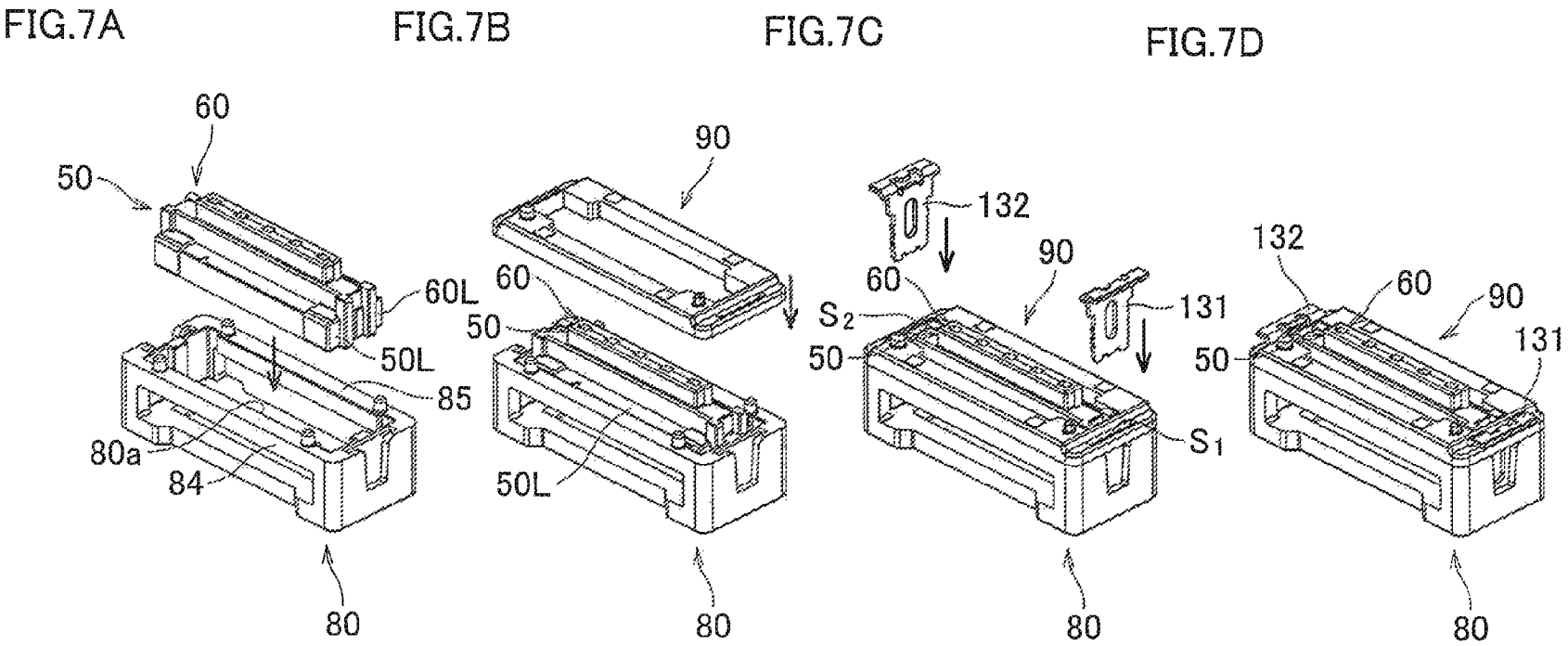
FIGS. 7A to 7D are perspective views of the guide connector, showing a sequence of assembling the guide connector.

As shown in FIG. 7A, the first movable body 50 and the second movable body 60 are first brought close to each other while sandwiching the springs 141 and 142 (not shown). The two movable bodies 50 and 60 held in the above state are put in the box-like body 80 through the opening 80*a* at the upper end portion of the box-like body 80. At this time, an outer side surface of the lower stage 50L of the first movable body 50 and an outer side surface of the lower stage 60L of the second movable body 60 (each outer side surface is a surface extending in the left/right directions) are brought into contact with the restriction beams 84 and 85 of the box-like body 80, respectively, and thereby the two movable bodies 50 and 60 are held in the close state (see FIG. 7B).

Then, the lid 90 is attached to the upper end of the box-like body 80 (see FIGS. 7B and 7C). Thereafter, the strengthening tabs 131 and 132 are respectively inserted into the slits $S_1$ and $S_2$ of the housing 70 (see FIGS. 7C and 7D).

Next, description will be given for a process of transition of the first movable body 50 and the second movable body 60 from the close state to the separated state, with reference to FIGS. 8A to 8C. FIGS. 8A to 8C are sectional views, each taken along a line IIA-IIA, a line IIB-IIB, and a line IIC-IIC of FIG. 1. It should be noted that, in each of FIGS. 8A to 8C, there are illustrated: the pressing pin 5 out of the pressing pins 4 and 5; the contact insertion hole 3A out of the contact insertion holes 3A to 3E; a contact 120 out of the contacts 120; and the spring 142 out of the springs 141 and 142.

First, as shown in FIG. 8A, the female connector 2 is soldered onto an upper surface of the substrate 110. At this time, the slider 1 is disposed so as to cover the top of the female connector 2, and each of the pins 7 is not inserted between the protruding portion of the front wall portion 31 and the projecting portion 43 of the corresponding female contact 20 (semi-fit state). Further, the guide connector 3 is secured to the lower surface of the substrate 110, and the first movable body 50 and the second movable body 60 are in the close state.

In the close state, the outer side surface of the lower stage 50L of the first movable body 50 and the outer side surface of the lower stage 60L of the second movable body 60 are respectively in contact with the restriction beams 84 and 85 of the guide connector 3. The female connector 2 is on the substrate 110. Each of the pressing pins 4 and 5 is located above the middle stage 50M of the first movable body 50 and the middle stage 60M of the second movable body 60, at a position offset toward the front from the center of the guide connector 3 with respect to the front/rear directions (see FIG. 5A).

Then, the contacts 120 are inserted into the guide connector 3 from below (see FIG. 8B). Each contact 120 passes through the corresponding contact insertion hole (3A to 3E) of the guide connector 3, and penetrates the substrate 110. Then, each contact 120 is inserted between the protruding portion of the back wall portion 32 and the straight portion 42 of the corresponding female contact 20. This causes the contact 120 to contact at least one of the back wall portion 32 and the straight portion 42, and thereby electric connection between them is established.

In this state, the slider 1 is pressed down (full-fit state). This moves the pressing pins 4 and 5 downward, to press the middle stage 50M of the first movable body 50 and the middle stage 60M of the second movable body 60 (see FIG. 5A). With this, the two movable bodies 50 and 60 are pressed down, and moved away from the female connector 2. The lower stage 50L of the first movable body 50 and the lower stage 60L of the second movable body 60 are also moved downward, with the result that the outer side surfaces of the lower stages 50L and 60L detach from the restriction beams 84 and 85 (see FIG. 5B). Thus, the first movable body 50 and the second movable body 60 are released. As a result, the springs 141 and 142 extend, which moves the first movable body 50 and the second movable body 60 in directions away from each other, to move the first and second movable bodies 50 and 60 away from the contacts 120 (see FIG. 8C). Then, the middle stage 50M of the first movable body 50 and the middle stage 60M of the second movable body 60 are respectively brought into contact with the restriction beams 84 and 85, and the upper stage 50T of the first movable body 50 and the upper stage 60T of the second movable body 60 are brought into contact with the lid 90 (see FIG. 8C). This restricts further movement of the first movable body 50 and the second movable body 60.

Note that FIGS. 5B, 6B, and 8C each shows the state where the pressing pins 4 and 5 are pressed down while the opposing surfaces of the first movable body 50 and the second movable body 60 lie along the up/down directions (i.e., the direction orthogonal to the substrate). However, the first movable body 50 and the second movable body 60 are unstable because only the lower stages 50L and 60L are held by the restriction beams 84 and 85 (see FIG. 5A), and therefore, rotational movement of the first movable body 50 and/or the second movable body 60 may be caused, if vibrations or the like are created before the pressing pins 4 and 5 are pressed down, for example, during the movement of the guide connector 3 to the position below the substrate 110.

If such rotation of the movable bodies 50 and 60 goes beyond a certain extent before pressing down the pressing pins 4 and 5, the movable bodies 50 and 60 are not sufficiently pressed down by the pressing pins 4 and 5. Further, if the degree of the rotation is too large, the movable bodies 50 and 60 might not be pressed down. The movable bodies which have not been sufficiently pressed down are located close to the contacts 120 since the movable bodies do not make a transition to the separated state. In this case, the movable bodies may contact the contacts 120, leading to wear or breakage of the contacts 120.

In this embodiment, the restriction ribs 182 and 183 are always interposed between the first movable body 50 and the second movable body 60 (see FIG. 6A), and this restricts the rotational movement of the first movable body 50 and the second movable body 60.

Figure 9A:
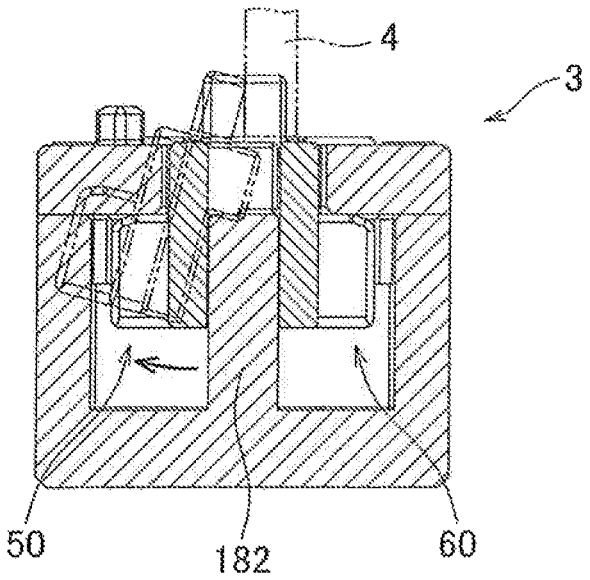
FIG. 9A is a sectional view of the guide connector, showing rotational movement of a first movable body.
Figure 9B:
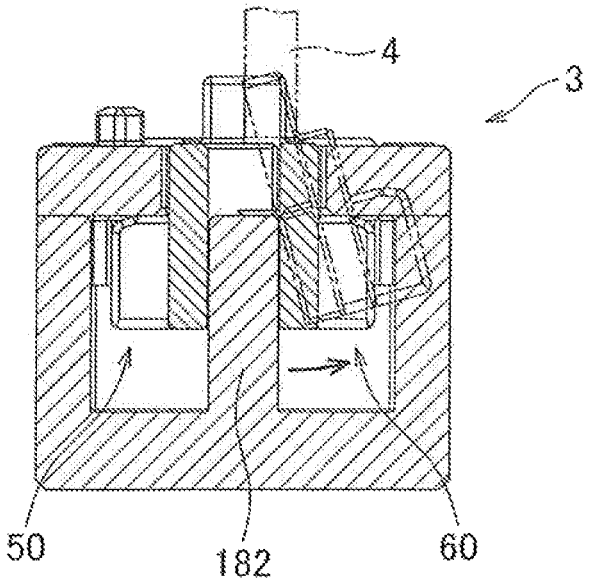
FIG. 9B is a sectional view of the guide connector, showing rotational movement of a second movable body.

For example, as shown in FIG. 9A, the first movable body 50 rotationally moves while sliding on and contacting the restriction rib 182, and therefore the degree of rotation of the first movable body 50 is limited. As shown in FIG. 9B, the second movable body 60 also rotationally moves while sliding on and contacting the restriction rib 182, and therefore the degree of rotation of the second movable body 60 is limited. Thus, in this embodiment, the degree of rotation of the first movable body 50 and the degree of rotation of the second movable body 60 are smaller than those in the case where the restriction ribs 182 and 183 are not provided. Due to this structure, the first movable body 50 and the second movable body 60 are sufficiently pressed down by the pressing pins 4 and 5. This enables the first movable body 50 and the second movable body 60 to make a transition to the separated state, so that the two movable bodies 50 and 60 are moved, away from the contacts 120, as shown in FIG. 8C.

As described above, the connector 100 of this embodiment provides the following advantageous effects. The first movable body 50 and the second movable body 60 are pressed using the pressing pins 4 and 5 after the electrical connection between the contacts 120 and the respective female contacts 20 are established, and thereby the two movable bodies 50 and 60 are moved away from the contacts 120. Thus, even if the housing 70, the first movable body 50, and the second movable body 60 are vibrated, or even if the substrate 110 is vibrated in addition to these members to cause resonance, the contacts 120 are not influenced by such vibration and/or resonance. Accordingly, wear of and damage to the contacts 120 are prevented.

Further, the restriction ribs 182 and 183 are disposed between the first movable body 50 and the second movable body 60, and the restriction ribs 182 and 183 are always interposed between the two movable bodies 50 and 60 during the transition from the close state to the separated state. With this, the first movable body 50 and the second movable body 60 rotationally move while contacting the restriction ribs 182 and 183, and therefore the degrees of the rotation of the bodies are smaller. This prevents the first movable body 50 and/or the second movable body 60 from being positionally shifted before being pressed by the pressing pins 4 and 5. This ensures pressing of the two movable bodies 50 and 60, and therefore ensures that the two movable bodies 50 and 60 are moved away from the contacts 120.

Further, the restriction ribs 182 and 183 extend in the up/down directions (the direction orthogonal to the substrate 110), and the surfaces 54 and 64 which oppose the restriction ribs 182 and 183 also extend in the up/down directions. This ensures restriction of the rotational movement of the first movable body 50 and the second movable body 60.

In addition, the first movable body 50 and the second movable body 60 are configured to be slidable on the restriction ribs 182 and 183, and in the close state, there in no gap between the first movable body 50 and each of the restriction ribs 182 and 183 and between the second movable body 60 and each of the restriction ribs 182 and 183. That is, in the close state, the first movable body 50 and the second movable body 60 are in contact with each of the restriction ribs 182 and 183, and this ensures restriction of the rotational movement of the first movable body 50 and the second movable body 60.

Further, with a simple arrangement in which the restriction ribs 182 and 183 are provided to the box-like body 80 of the housing 70, the rotational movement of the two movable bodies 50 and 60 is restricted.

Further, in this embodiment, the positions where the pressing pins 4 and 6 are fixed are offset toward the front from the center with respect to the front/rear directions. On each of the top surfaces of the right end section $R_1$ and the left end section $L_1$ above which the pressing pins 4 and 5 are respectively to be positioned, the line of the interface between the first movable body 50 and the second movable body 60 is offset toward the front from the center with respect to the front/rear directions. Therefore, it is possible to press the two movable bodies 50 and 60 using the pressing pins 4 and 5. As a result, the two movable bodies 50 and 60 are moved away from the contacts 120.

Further, in the right end section $R_1$ and the left end section $L_1$, the interface between the lower stages 50L and 60L accommodating the springs 141 and 142 is positioned at the center with respect to the front/rear directions, and therefore each of the springs 141 and 142 is equally held by the two movable bodies 50 and 60. This allows the springs 141 and 142 to extend in balance in the front/rear directions, to move the both movable bodies 50 and 60 away from the contacts 120.

Second Embodiment

The following describes a second embodiment of the present invention with reference to FIGS. 10A to 19C. A connector of the second embodiment is different from that of the first embodiment in the structure of the guide connector. Note that the components same as those in the first embodiment are given the same reference numerals, and the description thereof will be omitted if appropriate. Further, in FIGS. 14B and 15B, the pressing pins 4 and 5 are not illustrated.

(Guide Connector)

Figure 10A:
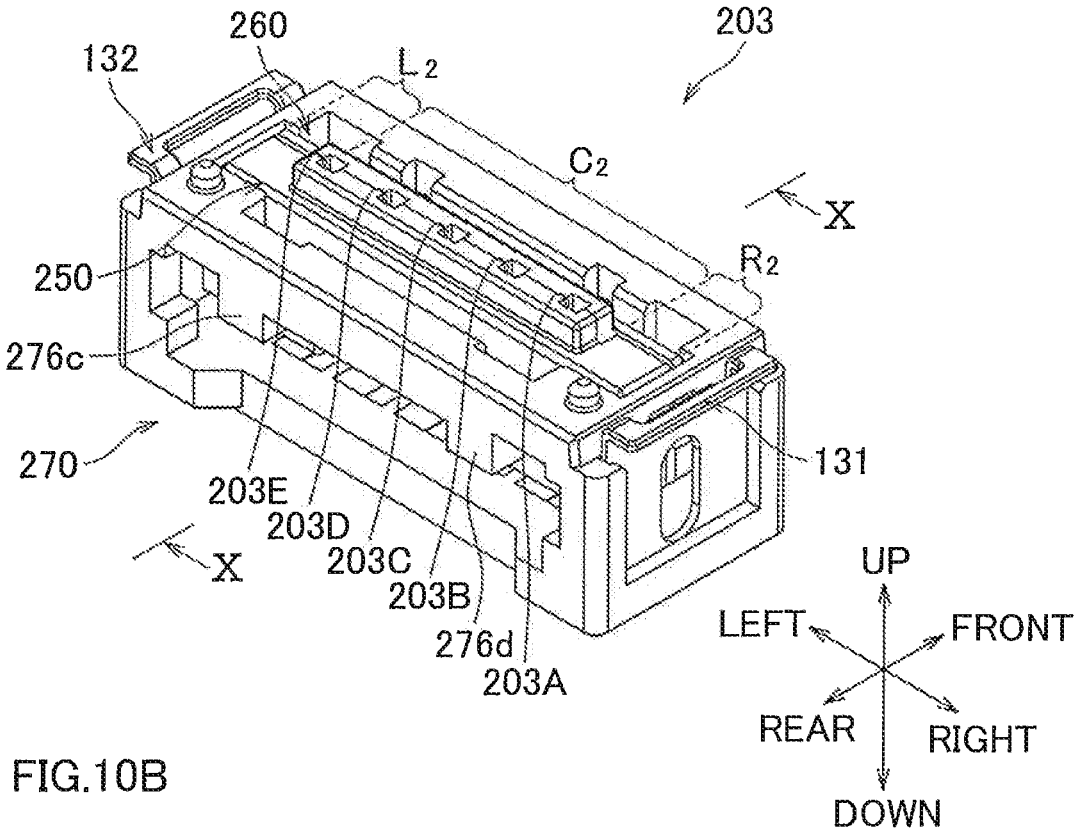
FIG. 10A is a perspective view of a guide connector of a second embodiment of the present invention, including a top surface of the guide connector.
Figure 10B:
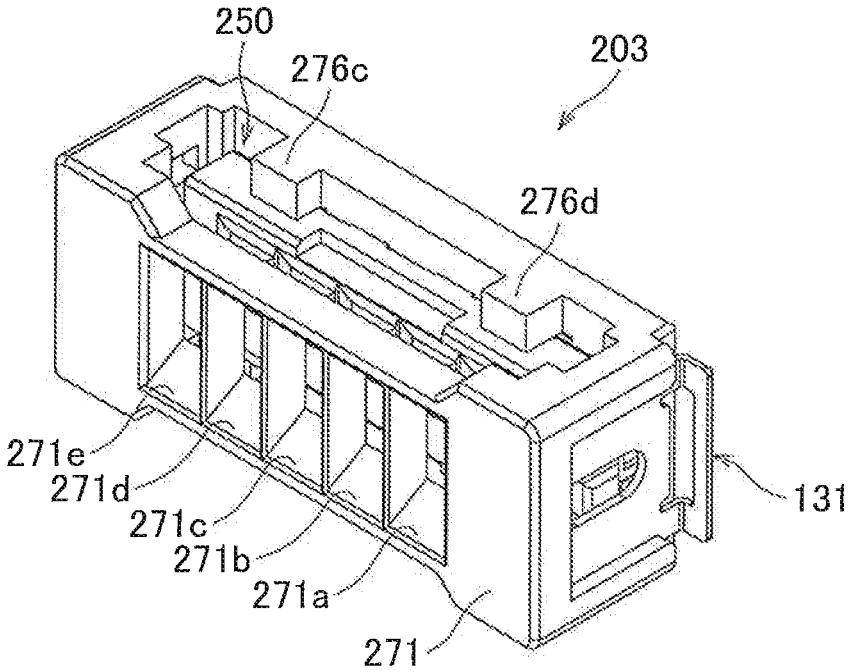
FIG. 10B is a perspective view of the guide connector of the second embodiment of the present invention, including a bottom surface of the guide connector.
Figure 11:
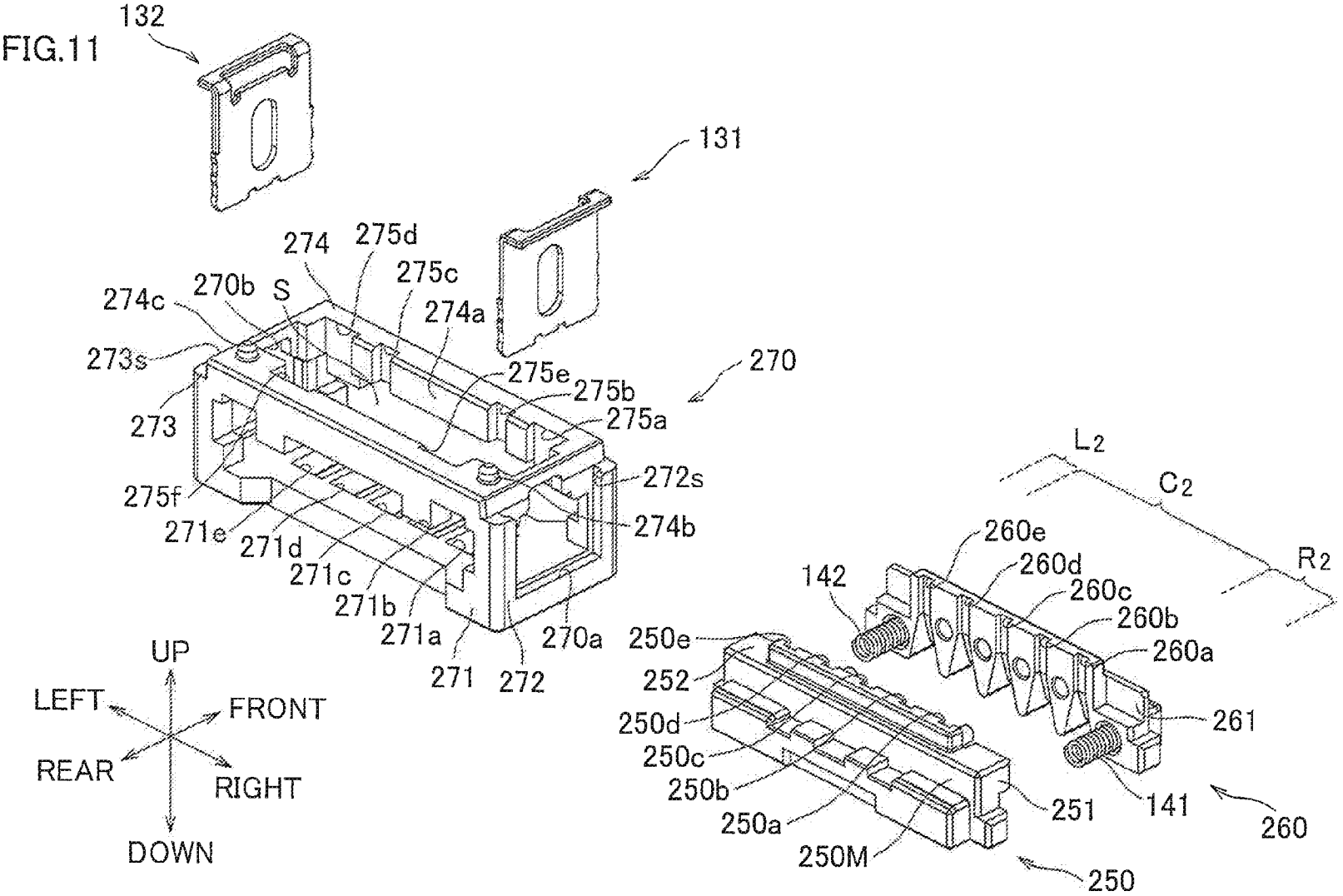
FIG. 11 is an exploded perspective view of the guide connector shown in FIG. 10A.

As shown in FIGS. 10A to 11, a guide connector 203 includes: a first movable body 250 (a rear movable body) and a second movable body 260 (a front movable body); and a substantially box-shaped housing (a first housing) 270 accommodating the first and second movable bodies 250 and 260. The strengthening tabs 131 and 132 are respectively attached to the right and left end portions of the housing 270. The first movable body 250, the second movable body 260, the housing 270, and the strengthening tabs 131 and 132 all are made of an insulative resin. As shown in FIG. 11, the springs (biasing member) 141 and 142 are respectively disposed between the right end portions of the two movable bodies 250 and 260 and between the left end portions of the two movable bodies 250 and 260. In the close state, the opposing surfaces of the first movable body 250 and the second movable body 260 are in contact with each other. The pressing pins 4 and 5 respectively to be positioned above a right end section $R_2$ and a left end section $L_2$ of the first movable body 250 and the second movable body 260 (see FIG. 13A).

[First Movable Body, Second Movable Body]

<Central Section $C_2$>

As shown in FIG. 11, a central section $C_2$ of the first movable body 250 and the second movable body 260 has three stages which are an upper stage, a middle stage, and a lower stage. As shown in FIG. 11, the first movable body 250 has, on a surface opposing the second movable body 260, five recesses 250*a*, 250*b*, 250*c*, 250*d*, and 250*e* aligned in the left/right directions. Further, the second movable body 260 has, on a surface opposing the first movable body 250, five recesses 260*a*, 260*b*, 260*c*, 260*d*, and 260*e* aligned in the left/right directions. These recesses are formed so that the recesses of the first movable body 250 respectively oppose the recesses of the second movable body 260 with respect to the front/rear directions (for example, the recess 250*a* of the first movable body 250 opposes the recess 260*a* of the second movable body 260). In the close state, opposing two recesses (e.g., the recess 250*a* and the recess 260*a*) form one contact insertion hole (e.g., a contact, insertion hole 203A) (see FIG. 10A). In this embodiment, the opposing surfaces of the first movable body 250 and the second movable body 260 define five contact insertion holes 203A, 203B, 203C, 203D, and 203E.

Each of the contact insertion holes 203A, 203B, 203C, 203D, and 203E includes an upper section 203*u* whose diameter is constant, and a tapered section 203*t* whose diameter decreases toward the upper section 203*u* (see FIG. 19A). The tapered section 203*t* is located below the upper section 203*u*. Note that FIG. 19A illustrates the contact insertion hole 203A out of the contact insertion holes 203A to 203E. The upper section 203*u* and the upper end of the tapered section 203*t* have the smallest diameter of the contact insertion hole (203A to 203E). The smallest diameter is not smaller than the diameter of each contact 120.

Figure 12B:
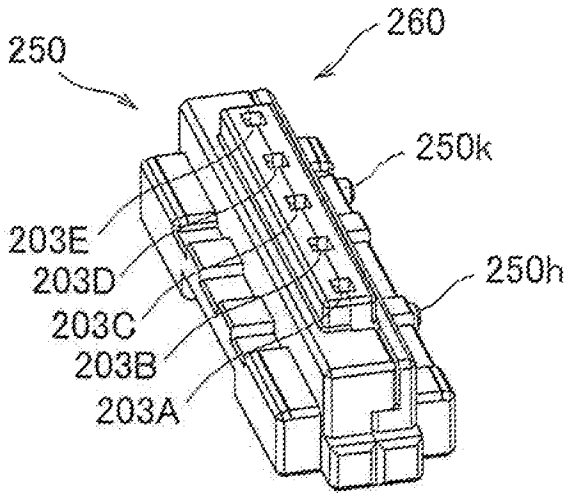
FIG. 12B is a perspective view of the first and second movable bodies shown in FIG. 10A, the movable bodies being in the close state.
Figure 12A:
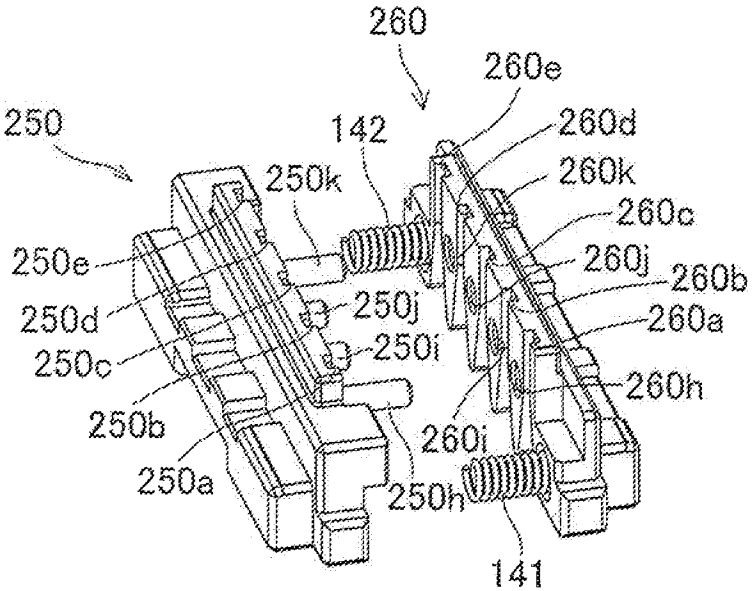
FIG. 12A is a perspective view of the first and second movable bodies shown in FIG. 10A, the movable bodies being in the separated state.

As shown in FIG. 12A, the first movable body 250 is provided with cylindrical bosses (a projection) 250*h*, 250*i*, 250*j*, and 250*k* aligned in the left/right directions. Each of the bosses protrudes toward the second movable body 260 and is formed between corresponding two adjacent recesses. Among the four bosses, the right and left bosses 250*h* and 250*k* are longer than the two bosses 250*i* and 250*j* interposed between the bosses 250*h* and 250*k*.

The second movable body 260 has cylindrical holes (a space) 260*b*, 260*i*, 260*j*, and 260*k* which are through holes each extending in the front/rear directions. Each of the holes 260*h*, 260*i*, 260*j*, and 260*k* is formed between the corresponding two recesses adjacent to each other (e.g., between the recess 260*a* and the recess 260*b*). The holes 260*h*, 260*i*, 260*j*, and 260*k* are positioned so as to correspond to the bosses 250*h*, 250*i*, 250*j*, and 250*k* of the first movable body 250.

In the close state, the bosses 250*h*, 250*i*, 250*j*, and 250*k* of the first movable body 250 are respectively inserted into the holes 260*h*, 260*i*, 260*j*, and 260*k* of the second movable body 260. In the close state, as shown in FIG. 12B, the right and left bosses 250*h* and 250*k* penetrate the second movable body 260, and protrude from the second movable body 260 (see FIG. 13A).

In this state, as shown in FIG. 14A, the boss 250*h*, for example, is sandwiched, with respect to the up/down directions, by an upper wall portion (a first support surface) 261*u* and a lower wall portion (a second support surface) 2611 each of which wall portions is a part of a curved surface defining the hole 260*h*. The thus sandwiched portion of the boss 250*h* overlaps the second movable body 260 when viewed from the up/down directions.

If the first movable body 250 attempts to rotate, its rotation is stopped by the lower wall portion 2611 contacting the boss 250*h*. Further, if the second movable body 260 attempts to rotate, its rotation is stopped by the upper wall portion 261*u* contacting the boss 250*h*.

Furthermore, during the transition from the close state to the separated state, the bosses 250*h*, 250*i*, 250*j*, and 250*k* guide the first movable body 250 and the second movable body in the front/rear directions, as shown in FIGS. 13A to 14B.

As shown in FIG. 14A, in the central section $C_2$, the interface between the first movable body 250 and the second movable body 260 is located substantially at the center with respect to the front/rear directions, across the length of the interface from the upper end to the lower end, except the interface, for example, between the boss 250*h* and the hole 260*h*. That is, except the interface between each boss (250*h*, 250*i*, 250*j*, 250*k*) and the corresponding hole (260*h*, 260*i*, 260*j*, and 260*k*), the interface is located substantially at the center with respect to the front/rear directions across its length from the upper end to the lower end.

Meanwhile, in the separated state, as shown in FIGS. 13B and 14B, all the bosses 250*h*, 250*i*, 250*j*, and 250*k* are not in the holes 260*h*, 260*i*, 260*j*, and 260*k*, respectively and the bosses 250*h*, 250*i*, 250*j*, and 250*k* are not in contact with the second movable body 260 (see FIG. 15B).

<Right End Section $R_2$, Left End Section $L_2$>

As shown in FIG. 11, in the right end section $R_2$, a middle stage 250M of the first movable body 250 is provided with a projection 251 projecting toward the second movable body 260. On the other hand, a middle stage 260M of the second movable body 260 has a dent 261 capable of receiving the projection 251. In the close state, the projection 251 is received in the dent 261. Therefore, as shown in FIG. 15A, the interface between the middle stage 250M of the first movable body 250 and the middle stages 260M of the second movable body 260 is offset toward the front from the center with respect to the front/rear directions, while the interface between a lower stage 250L of the first movable body 250 and a lower stage 260L of the second movable body 260 is located substantially at the center with respect to the front/rear directions. The projection 251 of the first movable body 250 overlaps the lower stage 260L of the second movable body 260 when viewed from the up/down directions. The pressing pin 4 is to be positioned above the overlapping portions.

The lower stages 250L and 260L accommodate the spring 141. In the lower stages 250L and 260L, the interface between the two movable bodies 250 and 260 intersects the spring 141. The spring 141 is located in a hole 252 of the first movable body 250 and a hole 262 of the second movable body 260. The holes 252 and 262 oppose each other in the front/rear directions, and have substantially the same size. Therefore, in the close state, the rear half of the spring 141 is located in the hole 252, and the front half of the spring 141 is located in the hole 262. Thus, the spring 141 is held by the first movable body 250 and the second movable body 260 substantially equally. When the first movable body 250 and the second movable body 260 are released, the spring 141 extends toward the front and the back equally, as shown in FIG. 15B.

The left end section $L_2$ has substantially the same structure as that of the right end section $R_2$. As shown in FIG. 15A, also in the left end section $L_2$, the interface between the respective middle stages of the first movable body 250 and the second movable body 260 in the close state is offset toward the front from the center with respect to the front/rear directions, while the interface between the respective lower stages of the first movable body 250 and the second movable body 260 is positioned substantially at the center with respect to the front/rear directions. Further, the two movable bodies 250 and 260 partially overlap each other when viewed from the up/down directions. In this embodiment, the pressing pin 5 is fixed so as to be located above the overlapping portions (see FIG. 14A).

Referring back to FIG. 13A, in the close state, the line of the interface between the first movable body 250 and the second movable body 260 which line is on a top surface of the guide connector 203 is located substantially at the center with respect to the front/rear directions in the central section $C_2$, while the line of the interface is offset toward the front from the center with respect to the front/rear directions in the right end section $R_2$ and in the left end section $L_2$.

[Housing]

As shown in FIG. 11, the housing 270 includes a bottom wall 271, a right wall 272, a left wall 273, and a top wall 274. These walls define, inside the housing 270, an accommodation space S capable of accommodating the first movable body 250 and the second movable body 260. The housing 270 has, at the right and left end portions thereof, holes 270*a* and 270*b* each communicating with the accommodation space S. Each of the holes 270*a* and 270*b* is sized so than the two movable bodies 250 and 260 held in the close state can be inserted at the same time in the left/right directions (see FIG. 17B).

The bottom wall 271 has five guide holes 271*a*, 271*b*, 271*c*, 271*d*, and 271*e* aligned in the left/right directions. Each of the holes is a through hole extending in a direction of the thickness of the bottom wall 271 (i.e., in the up/down directions). Above the guide holes 271*a*, 271*b*, 271*c*, 271*d*, and 271*e*, the contact insertion hole 203A, 203B, 203C, 203D, and 203E are respectively positioned (see FIGS. 19A to 19C).

Furthermore, the right well 272 and the left wall 273 of the housing 270 respectively have slits 272*s* and 273*s* into which the strengthening tabs 131 and 132 are respectively inserted.

The top wall 274 has an opening 274*a*. The top wall 274 has four recesses 275*a*, 275*b*, 275*c*, and 275*d* aligned in the left/right directions. These recesses are formed on a front inner wall surface of inner wall surfaces of the top wall 274 which surfaces defining the opening 274*a* in the front/rear directions. The bosses 250*h* and 250*k* are respectively fitted into the two recesses 275*b* and 275*c* of the four recesses (see FIG. 13A), which two recesses are interposed between the remaining right and left recesses. Further, on the rear inner wall surface of the above inner wall surfaces of the top wall 274, two recesses 275*e* and 275*f* are formed so as to be aligned in the left/right directions, as shown in FIG. 11.

Furthermore, as shown in FIG. 11, the top wall 274 is provided with bosses 274*b* and 274*c* on a top surface of the top wall 274. The bosses 274*b* and 274*c* are configured to be fitted in holes (not shown) on the lower surface of the substrate 110 (see FIGS. 14A to 15B).

Figure 16:
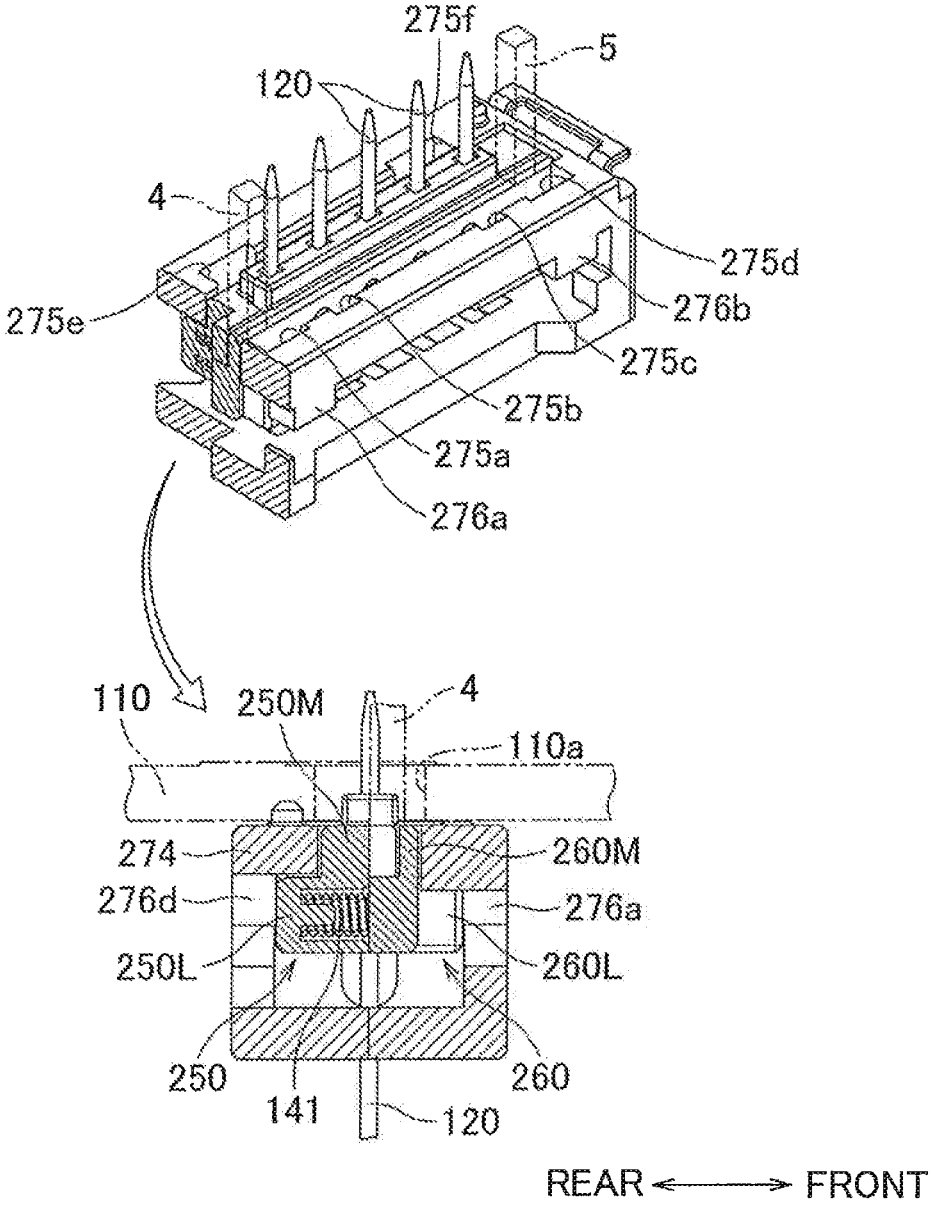
FIG. 16 includes another perspective view and another sectional view of the guide connector shown in FIGS. 10A and 10B, the guide connector being in the close state.

As shown in FIGS. 15A and 16, in the close state, the middle stages 250M of the first movable body 250 and the middle stage 260M of the second movable body 260 contact an inner circumferential surface (the surface facing the opening 274*a*) of the top wall 274 except the portions where the recesses 275*a*, 275*b*, 275*c*, 275*d*, 275*e*, and 275*f* are formed. Further, each of the lower stages 250L and 260L contacts portions projecting downward from an under surface of the top wall 274 (projections 276*a* and 276*b* in FIGS. 15A and 16, projections 276*c* and 276*d* in FIG. 10B). The projections 276*a*, 276*b*, 276*c*, and 276*d* respectively define the recesses 275*a*, 275*d*, 275*e*, and 275*f* formed on the inner circumferential surface of the top wall 274 (see FIG. 11).

In the separated state, as shown in FIG. 15B, each of the middle stage 250M of the first movable body 250 and the middle stage 260M of the second movable body 260 contacts the portions projecting downward from the under surface of the top wall 274 (the projections 276*a* and 276*b* shown in FIG. 15B, the projections 276*c* and 276*d* shown in FIG. 10B). This restricts the movement of the first movable body 250 and the second movable body 260 in the directions away from each other.

Now, a process of assembling the guide connector 203 will be described, with reference to FIGS. 17A to 17D.

Figure 17A:
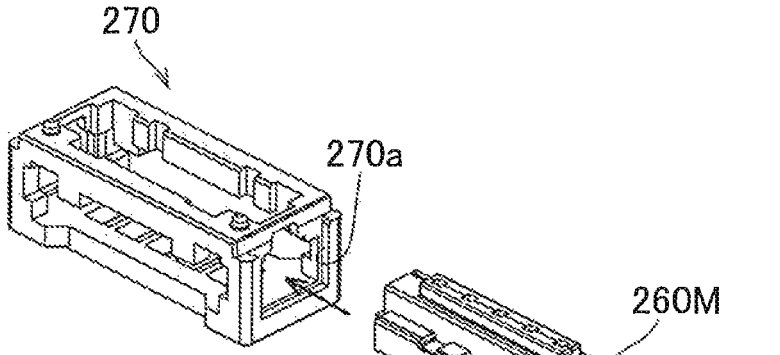
FIGS. 17A to 17D are perspective views of the guide connector shown in FIGS. 10A and 10B, and show a sequence of assembling the guide connector.
Figure 17B:
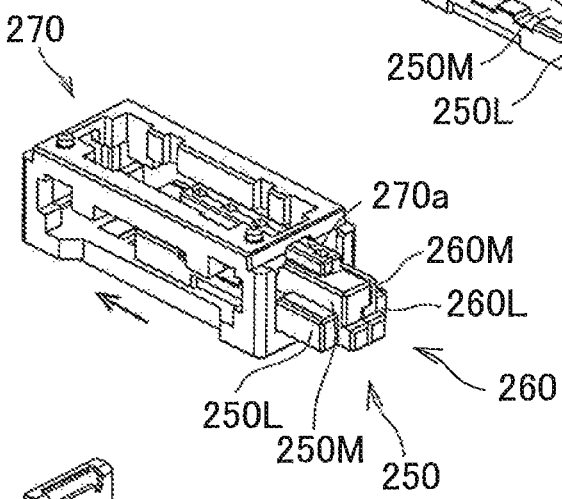

As shown in FIG. 17A, the first movable body 250 and the second movable body 260 are first brought close to each other while sandwiching the springs 141 and 142 (not shown). The two movable bodies 250 and 260 held in the above state are put in the housing 270 through the hole 270*a* at the right end portion of the housing 270 (see FIG. 17B).

Figure 17C:
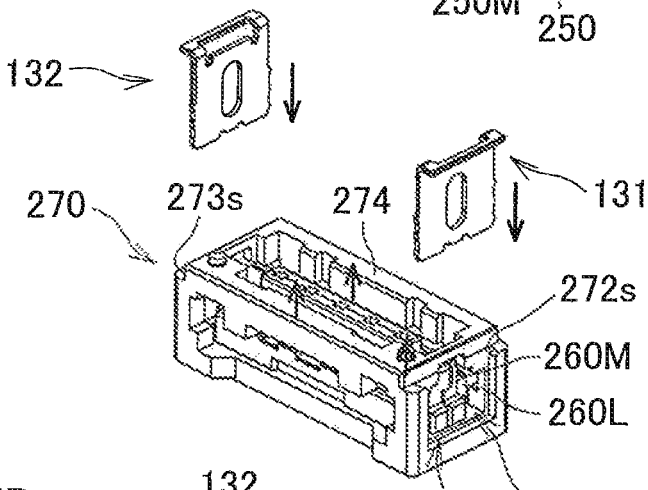
Figure 17D:
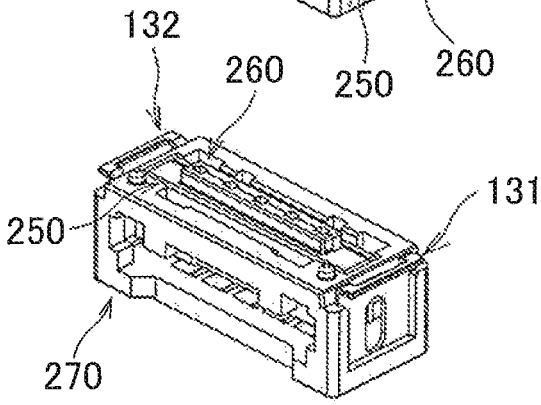

Then, the first movable body 250 and the second movable body 260 are lifted up while maintaining the close state. The middle stage 250M and the lower stage 250L of the first movable body 250 and the middle stage 260M and the lower stage 260L of the second movable body 260 are brought into contact with the inner circumferential surface of the top wall 274 of the housing 270 (see FIG. 16). This keeps the two movable bodies 250 and 260 in the close state. Then, the strengthening tabs 131 and 132 are respectively inserted into the slits 272*s* and 273*s* of the housing 270 (FIGS. 17C and 17D).

In the close state, as shown in FIG. 18A, a part of the interface between the first movable body 250 and the second movable body 260 and its periphery are positioned farther from a viewer of this figure than the through hole 131*a* bored in the strengthening tab 131, and the spring 141 (not shown) is positioned farther from the viewer than the part of the interface and its periphery. Therefore, even if foreign matter enters the housing 270 through the through hole 131*a*, the first movable body 250 and the second movable body 260 prevent the foreign matter from entering a gap in the spring 141. Although not shown, the same goes for the strengthening tab 132, After a transition from the close state to the separated state, the spring 141 is visible through the through hole 131*a* of the strengthening tab 131 as shown in FIG. 18B.

Next, description will be given for a process of the transition of the first movable body 250 and the second movable body 260 from the close state to the separated state, with reference to FIGS. 19A to 19C. FIGS. 19A to 19C are sectional views, each taken along the line IIA-IIA and the line IIB-IIB of FIG. 1, and a line X-X of FIG. 10. It should be noted that in each of FIGS. 19A to 19C, there are illustrated: the pressing pin 5 out of the pressing pins 4 and 5; the contact insertion hole 203A out of the contact insertion holes 203A to 203E; a contact 120 out of the contacts 120; and the spring 142 out of the springs 141 and 142.

First, as shown in FIG. 19A, the female connector 2 is soldered onto the upper surface of the substrate 110. At this time, the slider 1 is disposed so as to cover the top of the female connector 2, and each of the pins 7 is not inserted between the protruding portion of the front wall portion 31 and the projecting portion 43 of the corresponding female contact 20 (semi-fit state). Further, the guide connector 203 is secured to the lower surface of the substrate 110, and the first movable body 250 and the second movable body 260 are in the close state. Each of the pressing pins 4 and 5 is located above the middle stage 250M of the first movable body 250 and the middle stage 260M of the second movable body 260, and at a position offset toward the front from the center of the guide connector 203 with respect to the front/rear directions (see FIG. 16).

Then, the contacts 120 are inserted into the guide connector 203 from below (see FIG. 19B). Each contact 120 passes through the corresponding contact insertion hole (203A to 203E) of the guide connector 203, and penetrates the substrate 110. Then, each contact 120 is inserted between the protruding portion of the back wall portion 32 and the straight portion 42 of the corresponding female contact 20. This causes the contact 120 to contact at least one of the back wall portion 32 and the straight portion 42, and thereby electric connection between them is established.

In this state, the slider 1 is pressed down (full-fit state). This moves the pressing pins 4 and 5 downward, to press the middle stage 250M of the first movable body 250 and the middle stage 260M of the second movable body 260. With this, the two movable bodies 250 and 260 are pressed down, and moved away from the female connector 2. Further, the middle stage 250M and the lower stage 250L of the first movable body 250 and the middle stage 260M and the lower stage 260L of the second movable body 260 detach from the inner circumferential surface of the top wall 214. Thus, the first movable body 250 and the second movable body 260 are released, and thereby the springs 141 and 142 extend. Biased by the springs 141 and 142, the first movable body 250 and the second movable body 260 are moved in the directions away from each other, and moved away from the contacts 120 (see FIG. 19C). Thereafter, the middle stage 250M of the first movable body 250 and the middle stage 260M of the second movable body 260 are brought into contact with the inner circumferential surface of the top wall 274 (specifically, with the projections 276*c* and 276*d* shown in FIG. 10B, the projections 276*a* and 276*b* shown in FIG. 15B). This restricts further movement of the first movable body 250 and the second movable body 260.

Further, the slider 1 is pressed down. This causes each pin 7 to be positioned between the protruding portion of the front wall portion 31 and the projecting portion 43 of the corresponding female contact 20, as shown in FIG. 19C. This displaces the projecting portion 43 toward the corresponding contact 120, thus improving accessibility between the female contact 20 and the contact 120.

Thus, in this embodiment, as well as is in the first embodiment, the first movable body 250 and the second movable body 260 are pressed using the pressing pins 4 and 5 after the electric connection between the contacts 120 and the respective female contacts 20 is established, and thereby the two movable bodies 250 and 260 are moved away from the contacts 120. Thus, even if the housing 270, the first movable body 250, and the second movable body 260 are vibrated, or even if the substrate 110 is vibrated in addition to these members to cause resonance, the contacts 120 are not influenced by such vibration and/or resonance. Accordingly, wear of and damage to the contacts 120 are prevented.

In this embodiment, the positions where the pressing pins 4 and 5 are fixed are offset toward the front from the center with respect to the front/rear directions. Also in the right end section $R_2$ and the left end section $L_2$, above which sections the pressing pins 4 and 5 are to be positioned respectively, the line of the interface between the first movable body 250 and the second movable body 260, which line is on the top surfaces, is offset toward the front from the center with respect to the front/rear directions. Therefore, the two movable bodies 250 and 260 are pressed by the pressing pins 4 and 5. As a result, the two movable bodies 250 and 260 are moved away from the contacts 120.

Further, in each of the right end section $R_2$ and the left end section $L_2$, the interface between the lower stages 250L and 260L accommodating the springs 141 and 142 is positioned substantially at the center with respect to the front/rear directions, and therefore each of the springs 141 and 142 is equally held by the two movable bodies 250 and 260. This allows the springs 141 and 142 to extend in balance in the front/rear directions, to move the both movable bodies 250 and 260 away from the contacts 120.

Furthermore, each of the bosses 250*h*, 250*i*, 250*j*, and 250*k* of the first movable body 250 is supported by the upper wall portion and the lower wall portion defining the corresponding one of the holes 260*h*, 260*i*, 260*j*, and 260*k* of the second movable body 260 (e.g., the boss 250*h* is supported by the upper wall portion 261*u* and the lower wall portion 2611) (see FIG. 14A), and this restricts the rotational movement of the first movable body 250 and the second movable body 260. This prevents the first movable body 250 and/or the second movable body 260 from being positionally shifted before being pressed by the pressing pins 4 and 5. This ensures pressing of the two movable bodies 250 and 260.

Moreover, in the separated state, the bosses 250*h*, 250*i*, 250*j*, and 250*k* are not located in the holes 260*h*, 260*i*, 260*j*, and 260*k*, respectively, and therefore the two movable bodies 250 and 260 are not in contact with each other (see FIG. 13B). This prevents transmission of vibration from one of the movable bodies to the other movable body.

Further, the rotational movement of the two movable bodies 250 and 260 is restricted with a simple structure in which the upper wall portion and the lower wall portion defining each hole (260*h*, 260*i*, 260*j*, 260*k*) are configured to support the corresponding boss (e.g., the upper wall portion 261*u* and the lower wall portion 2611 defining the hole 260*h* are configured to support the boss 250*h*).

In addition, each of the bosses 250*h* and 250*k* has a longer length in the front/rear directions, which allows the first movable body 250 and the second movable body 260 to be guided until immediately before completion of a transition to she separated state. Thus, the two movable bodies 250 and 260 are moved away from each other in their right directions (the front/rear directions).

Thus, the embodiments of the present invention are described hereinabove with reference to attached drawings. It should be however noted that specific structure of the present invention is not limited to these embodiments. The scope of the present invention is defined by claims, not by the above description, and shall encompass all changes that fall within the equivalent meaning and scope of the claims.

For example, the structure of the slider 1, the structure of the female connector 2, and the structure of the pressing pins 4 and 5 (such as the positions where the pins are attached, and the shape of the pins) are respectively not limited to those described in the above-described embodiments, and may be altered. The pressing pins 4 and 5 do not have to be attached to the slider 1. For example, the pressing member may be a member constituted by a long rod, and may be attached to a member other than the slider. Further, the slider 1 does not have to be included.

In the above-described embodiments, the transition of the first movable body 50, 250 and the second movable body 60, 260 from the close state to the separated state is made (see FIGS. 8C and 19C) after the electrical connection between each contact 120 and the corresponding female contact 20 is established. However, the timing of the transition to the separated state is not limited to this. For example, the transition to the separated state may be made simultaneously with the establishment of the electrical connection between each contact 120 and the corresponding female contact 20, as long as each contact 120 has been inserted into the corresponding contact insertion hole (e.g., the contact insertion hole 3A, 203A) of the guide connector 3, 203. Alternatively, the transition to the separated state may be made after the insertion of each contact 120 into the corresponding contact insertion hole and before the contact 120 is electrically connected with the corresponding female contact 20.

Figure 20A:
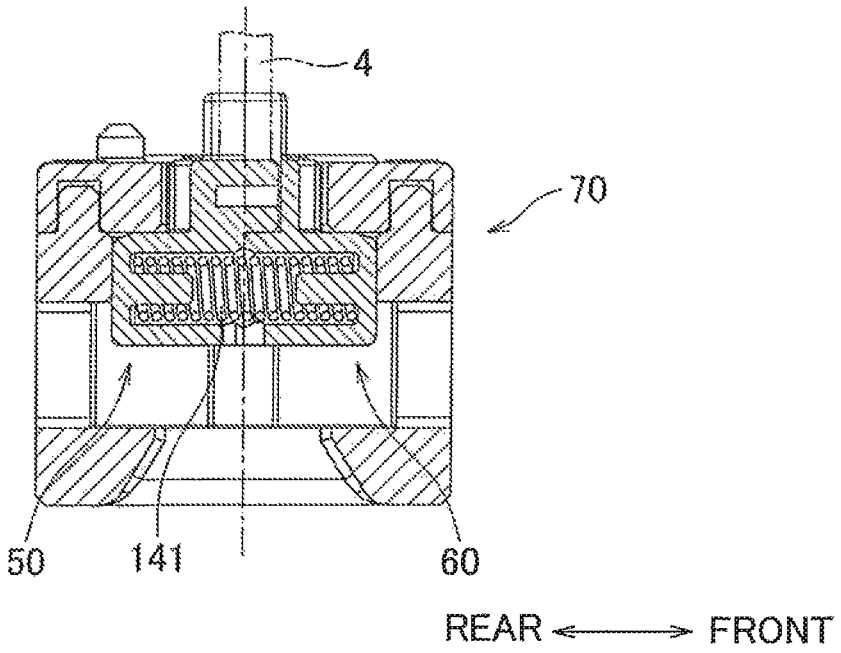
FIG. 20A is a sectional view of a guide connector of a modification.

Each of the above-described embodiments deals with the case where the pressing pins (pressing member) 4 and 5 press both of the first movable body 50, 250 and the second movable body 60, 260; however, the pressing member may press one of these movable bodies. For example, the structure shown in FIG. 20A is possible, in which each of the pressing pins 4 and 5 is positioned substantially at the center of the guide connector 3 with respect to the front/rear directions, to press the first movable body 50 without pressing the second movable body 60. (Note that in FIG. 20A, the pressing pin 4 out of the pressing pins 4 and 5 is illustrated.) In this case, each of the pressing pins 4 and 5 is positioned above the portion of the first movable body 50 which portion overlaps the second movable body 60. When the overlapping portion is pressed, the second movable body 60 is indirectly pressed, and therefore the two movable bodies 50 and 60 make transition to the separated state.

As shown in FIGS. 5A and 15A, in each of the above-described embodiments, the first movable body 50, 250 and the second movable body 60, 260 partially overlap each other in the right end section $R_1$, $R_2$ and in the left end section $L_1$, $L_2$. However, the two movable bodies do not have to overlap each other. The two movable bodies may partially overlap each other in either one of the right end section and the left end section.

Figure 20B:
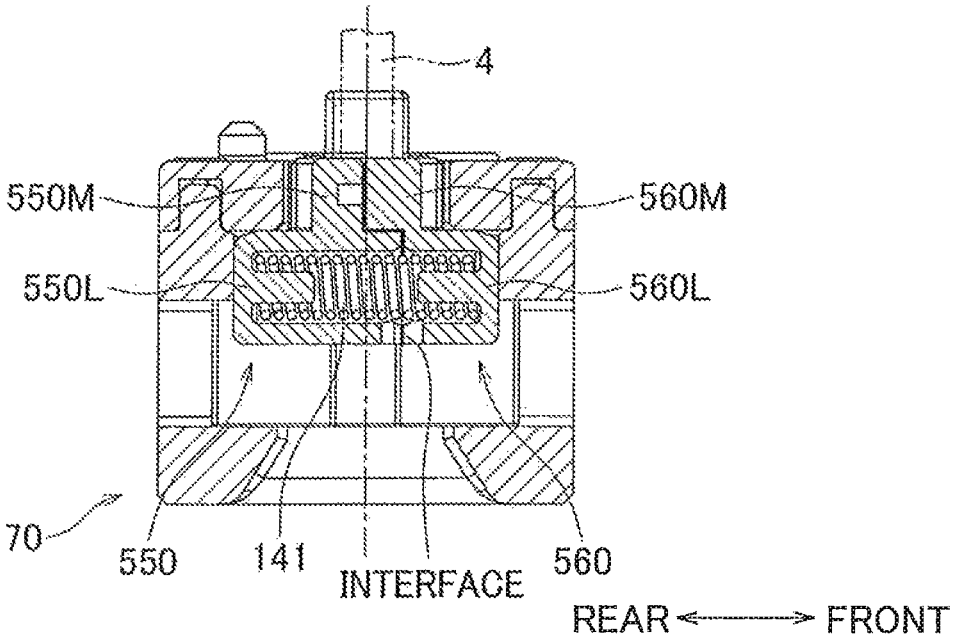
FIG. 20B is a sectional view of a guide connector of another modification.

Further, in the first embodiment, the interface between the middle stages 50M and 60M is offset toward the front from the center with respect to the front/rear directions in each of the right end section $R_1$ and the left end section $L_1$ (see FIG. 5A). In the second embodiment, the interface between the middle stages 250M and 260M is offset toward the front from the center with respect to the front/rear directions in each of the right end section $R_2$ and the left end section $L_2$ (see FIG. 15A). Instead, the interface between the lower stages 50L, 250L and 60L, 260L may be offset. For example, the structure shown in FIG. 20B is possible, in which the interface between a middle stage 550M of a first movable body 550 and a middle stage 560M of a second movable body 560 in the close state is positioned around the center with respect to the front/rear directions, and the interface between a lower stage 550L of the first movable body 550 and a lower stage 560L of the second movable body 560 is offset toward the front from the center with respect to the front/rear directions. In this structure, using the pressing pins fixed so as to be located at or around the center of the guide connector 3 with respect to the front/rear directions, the first movable body 550 and the second movable body 560 are pressed. Alternatively, the pressing pins may be fixed so as to be located offset toward the front from the center of the guide connector 3 with respect to the front/rear directions, as are in the above-described embodiments. In this case, only the first movable body 550 is directly pressed. However, the portion of the first movable body 550 which overlaps the second movable body 560 is pressed, and therefore the second movable body 560 is indirectly pressed. As a result, the two movable bodies 550 and 560 make a transition to the separated state.

Further, in each of the above-described embodiments, the strengthening tabs 131 and 132 are respectively inserted into the right and left end portions of the housing 70, 170; however, the strengthening tabs 131 and 132 do not have to be inserted.

Furthermore, in each of the above-described embodiments, the first movable body 50, 250 and the second movable body 60, 260 of the guide connector 3, 203 have similar structure; however, their structures may be different from each other.

Moreover, the springs 141 and 142 are used as the biasing member in each of the above-described embodiments; however, the biasing member may be a member other than the springs. For example, an elastic member such as rubber may be used as the biasing member.

The restriction ribs 182 and 183 of the first embodiment may be altered as follows.

The first embodiment deals with the cage where each of the restriction ribs 182 and 183 is disposed between the first movable body 50 and the second movable body 60; however, the restriction ribs 182 and 183 do not have to be included.

The first embodiment deals with the case where the restriction ribs 182 and 183 are provided to the housing 70; however, the restriction ribs 182 and 183 may be members separate from the housing 70. The shape, size, position and the like of the restriction ribs 182 and 183 are not limited those described in the first embodiment, and may be altered. For example, in the first embodiment (see FIGS. 3, 6A, and 6B), the restriction rib 182 extends in the up/down directions from the upper end to the lower end of the right wall 82; however, the restriction rib 182 does not have to extend in such a manner, and may be provided merely at the upper end portion of the right wall.

Further, as shown in FIGS. 6A and 6B, in the first embodiment, each of the surfaces 54 and 64 of the first movable body 50 and the second movable body 60 which surface opposes the restriction rib 182, 183 extends in the up/down directions. However, each of the surfaces 54 and 64 may be curved so as to form a protrusion toward the restriction rib 182, 183.

In addition, in the first embodiment, there is hardly any gap between the restriction ribs 182 and 183 and the surfaces 54 and 64 of the first movable body 50 and the second movable body 60 in the close state; however, there may be a gap therebetween.

Further, in the first embodiment, the windows 153 and 154 through which the springs 141 and 142 are respectively visible are formed at the bottom of the body formed by the first movable body 50 and the second movable body 60. However, such a window may be formed through the right wall portion and/or the left wall portion of the housing of the guide connector, for example.

The bosses 250*h*, 250*i*, 250*j*, and 250*k*, and the holes 260*h*, 260*i*, 260*j*, and 260*k* of the second embodiment may be altered as follows.

As shown in FIG. 11, in the second embodiment, the bosses 250*h*, 250*i*, 250*j*, and 250*k*, and the holes 260*h*, 260*i*, 260*j*, and 260*k* are provided in the central section $C_2$ of the first movable body 50 add the second movable body 60; however, these bosses and holes may be provided in the right end section $R_2$ and/or in the left end section $L_2$.

In the second embodiment, the bosses 250*h*, 250*i*, 250*j*, and 250*k* of the first movable body 250 are respectively configured to be inserted into the holes 260*h*, 260*i*, 260*j*, and 260*k* of the second movable body 260, and each boss is supported in such a manner that, for example, as shown in FIG. 14A, the boss 250*h* is supported by the upper wall portion (first support surface) 261*u* and the lower wall portion (second support surface) 2611 which wall portions form the inner wall defining the hole 260*h*. However, each of the bosses may be supported in another manner. For example, the second movable body may be provided with two projections A and B, each of which projections projects toward the first moveable body and opposes to the counterpart projection in the up/down directions, so that she bosses of the first movable body can be positioned in a space formed between the two projections A and B. Since each boss is supported by the projections A and B in the up/down directions, the rotation of the first movable body and the second movable body is prevented. In the above case, support surfaces opposing each other in the left/right directions (such as a right surface and a left surface) do not have to be provided.

Furthermore, in the second embodiment, the bosses 250*h*, 250*i*, 250*j*, and 250*k* of the first movable body 250 are not in contact with the second movable body 260 in the separated state (see FIG. 13B); however, the bosses may be in contact with the second movable body.

Additionally, in the second embodiment, the first movable body 250 is provided with the bosses 250*h*, 250*i*, 250*j*, and 250*k* and the second movable body 260 has the holes 260*h*, 260*i*, 260*j*, and 260*k*; however, the following arrangement is also possible: the first movable body has the holes, and the second movable body is provided with the bosses.

Further, in the second embodiment, the second movable body 260 has holes 260*h*, 260*i*, 260*j*, and 260*k* functioning as spaces for receiving the bosses 250*h*, 250*i*, 250*j*, and 250*k*. Instead of the holes, recesses may be provided depending on the length of the bosses.

Furthermore, the structure (e.g., the position, shape, and the size) of each boss and each hole is not limited to that described in the second embodiment, and may be altered.

What is claimed is:

1. A connector comprising: a first connector and a second connector which are configured to be disposed across a substrate from each other; and a pressing member, wherein:

the first connector comprises a first housing accommodating first and second movable bodies configured to be located across a first contact from each other, the first contact extending an a direction orthogonal to the substrate, and a biasing member configured to bias the first and second moveable bodies in directions away from each other;

the first and second movable bodies accommodated in the first housing are configured to make a transition from a close state to a separated state, the close state being a state in which the first and second movable bodies are biased by the biasing member and movement of the first and second movable bodies in the directions away from each other is restricted by the first housing, the separated state being a state in which the first and second movable bodies are more distant from the second connector than in the close state and the first and second movable bodies are made more distant from each other than in the close state by the biasing member;

the first and second movable bodies define a contact insertion hole in the close state, the contact insertion hole having a smallest diameter not smaller than a diameter of the first contact and including a section whose diameter decreases toward the substrate;

the second connector comprises a second housing and a second contact mounted in the second housing, the second contact configured to be electrically connected to the first contact passing through the contact insertion hole and penetrating the substrate; and the pressing member is configured to press at least one of the first and second movable bodies after the first contact passes through the contact insertion hole and penetrates the substrate and the electric connection between the first contact and the second contact is established, thereby to cause the first and second movable bodies to make the transition from the close state to the separated state.

2. The connector according to claim 1, wherein:

the first connector further comprises a restriction rib disposed between the first and second movable bodies; and the restriction rib is always interposed between the first and second movable bodies during the transition from the close state to the separated state.

3. The connector according to claim 2, wherein the restriction rib extends in the direction orthogonal to the substrate.

4. The connector according to claim 3, wherein each of surfaces of the first and second movable bodies which surfaces oppose the restriction rib extends in the direction orthogonal to the substrate.

5. The connector according to claim 4, wherein the first and second movable bodies are configured to be slidable on the restriction rib, and no gap is formed between the first and second movable bodies and the restriction rib.

6. The connector according to claim 2, wherein the restriction rib is provided to the first housing.

7. The connector according to claim 1, wherein;

the first movable body includes a first support surface and a second support surface opposing the first support surface in the direction orthogonal to the substrate, the first support surface and the second support surface create a space therebetween; and the second movable body includes a projection projecting toward the first movable body and configured to be positioned in the space in the close state.

8. The connector according to claim 7, wherein the projection is not positioned in the space in the separated state.

9. The connector according to claim 7, wherein each of the first and second support surfaces is a part of a curved surface defining a hole formed in the first movable body.

10. The connector according to claim 1, wherein at least a part of a line of an interface between the first and second movable bodies is offset from a center with respect to a relative movement direction in which the first and second movable bodies are moved relative to each other, the line being a line of intersection of (i) surfaces of the first, and second movable bodies each of which surfaces opposes the pressing member and (ii) the interface between the first and second movable bodies.

11. The connector according to claim 2, wherein at least a part of a line of an interface between the first and second movable bodies is offset from a center with respect to a relative movement direction in which the first and second movable bodies are moved relative to each other, the line being a line of intersection of (i) surfaces of the first and second movable bodies each of which surfaces opposes the pressing member and (ii) the interface between the first and second movable bodies.

12. The connector according to claim 7, wherein at least a part of a line of an interface between the first and second movable bodies is offset from a center with respect to a relative movement direction in which the first and second movable bodies are moved relative to each other, the line being a line of intersection of (i) surfaces of the first and second movable bodies each of which surfaces opposes the pressing member and (ii) the interface between the first and second movable bodies.

13. The connector according to claim 10, wherein the first movable body and the second movable body partially overlap each other when viewed from the direction orthogonal to the substrate so that a region of intersection of the interface between the first and second movable bodies and the biasing member is positioned substantially at the center with respect to the relative movement direction.

14. The connector according to claim 11, wherein the first movable body and the second movable body partially overlap each other when viewed from the direction orthogonal to the substrate so that a region of intersection of the interface between the first and second movable bodies and the biasing member is positioned substantially at the center with respect to the relative movement direction.

15. The connector according to claim 12, wherein the first movable body and the second movable body partially overlap each other when viewed from the direction orthogonal to the substrate so that a region of intersection of the interface between the first and second movable bodies and the biasing member is positioned substantially at the center with respect to the relative movement direction.

16. The connector according to claim 1, wherein the first movable body and the second movable body partially overlap each other when viewed from the direction orthogonal to the substrate.

17. The connector according to claim 2, wherein the first movable body and the second movable body partially overlap each other when viewed from the direction orthogonal to the substrate.

18. The connector according to claim 7, wherein the first movable body and the second movable body partially overlap each other when viewed from the direction orthogonal to the substrate.

19. A connector comprising:

a housing accommodating first and second movable bodies configured to be located across a contact from each other, the contact extending in a direction orthogonal to a substrate;

a biasing member configured to bias the first and second movable bodies in directions away from each other; and a restriction rib disposed between the first and second movable bodies, wherein:

one first and second movable bodies accommodated in the housing are configured to make a transition from a close state to a separated state, the close state being a state in which the first and second movable bodies are biased by the biasing member and movement of the first and second movable bodies in the directions away from each other is restricted by the housing, the separated state being a state in which the first and second movable bodies are made more distant from each other than in the close state by the biasing member;

the first and second movable bodies define a contact insertion hole in the close state, the contact insertion hole having a smallest diameter not smaller than a diameter of the contact and including a section whose diameter decreases toward the substrate; and the restriction rib is always interposed between the first and second movable bodies during the transition from the close state to the separated state.

20. A connector comprising;

a housing accommodating first and second movable bodies configured to be located across a contact from each other, the contact extending in a direction orthogonal to the substrate; and a biasing member configured to bias the first and second movable bodies in directions away from each other, wherein:

the first and second movable bodies accommodated in the housing are configured to make a transition from a close state to a separated state, the close state being a state in which the first and second movable bodies are biased by the biasing member and movement of the first and second movable bodies in the directions away from each other is restricted by the housing, the separated state being a state in which the first and second movable bodies are made more distant from each other than in the close state by the biasing member;

the first and second movable bodies define a contact insertion hole in the close state, the contact insertion hole having a smallest diameter not smaller than a diameter of the contact and including a section whose diameter decreases toward the substrate;

the first movable body includes a first support surface and a second support surface opposing the first support surface in the direction orthogonal to the substrate, the first support surface and the second support surface creating a space therebetween; and the second movable body includes a projection projecting toward the first movable body and configured to be positioned in the space in the close state.

* * * * *